US005385340A

United States Patent [19]

Hiroi et al.

[11] Patent Number: 5,385,340

[45] Date of Patent: Jan. 31, 1995

[54] SHEET POST-PROCESSING APPARATUS

[75] Inventors: Masakazu Hiroi, Yokohama; Mitsuhiro Mukasa, Kawasaki; Nobutaka Uto, Kanagawa; Masaaki Sato, Yokohama; Takeshi Honjo, Kawasaki, all of Japan

[73] Assignee: Canon Kabushiki Kaisha, Tokyo, Japan

[21] Appl. No.: 209,379

[22] Filed: Mar. 14, 1994

Related U.S. Application Data

[63] Continuation of Ser. No. 33,974, Mar. 19, 1993, abandoned, which is a continuation of Ser. No. 772,131, Oct. 9, 1991, abandoned, which is a continuation of Ser. No. 364,476, Jun. 12, 1989, abandoned.

[30] Foreign Application Priority Data

| | | | |
|---|---|---|---|
| Jun. 14, 1988 | [JP] | Japan | 63-146094 |
| Jul. 11, 1988 | [JP] | Japan | 63-172279 |
| Jul. 19, 1988 | [JP] | Japan | 63-181153 |

[51] Int. Cl.[6] ..... B31B 1/68; B65H 31/10

[52] U.S. Cl. ..... 270/53; 270/58

[58] Field of Search ..... 270/37, 53, 58; 355/324

[56] References Cited

U.S. PATENT DOCUMENTS

| | | | |
|---|---|---|---|
| 4,017,066 | 4/1977 | Lasher et al. | 270/58 X |
| 4,350,333 | 9/1982 | Landa . | |
| 4,424,963 | 1/1984 | Bartholet et al. | 270/53 |
| 4,509,732 | 4/1985 | Kanno | 270/37 |
| 4,552,497 | 11/1985 | Kockler et al. | 270/53 X |
| 4,566,782 | 1/1986 | Britt | 270/53 |
| 4,878,658 | 11/1989 | Honjo | 270/53 |
| 4,988,085 | 1/1991 | Maekawa et al. | 270/53 |
| 4,989,853 | 2/1991 | Matysek et al. | 270/58 |
| 4,989,854 | 2/1991 | McNamara | 270/52 |
| 5,021,837 | 6/1991 | Uto et al. | 270/53 |
| 5,137,265 | 8/1992 | Sato et al. | 270/37 X |
| 5,288,062 | 2/1994 | Rizzolo et al. | 270/53 |
| 5,289,251 | 2/1994 | Mandel et al. | 355/324 |
| 5,320,336 | 6/1994 | Asami | 270/58 |

FOREIGN PATENT DOCUMENTS

| | | | |
|---|---|---|---|
| 2724345 | 12/1977 | Germany . | |
| 62-269852 | 11/1987 | Japan | 270/53 |
| 63-117870 | 5/1988 | Japan | 270/53 |
| 127976 | 5/1988 | Japan | 270/53 |
| 2126997 | 4/1984 | United Kingdom . | |

OTHER PUBLICATIONS

Copy of European Search Report dated Aug. 18, 1989 with Abstract of 89110721.1 attached.

*Primary Examiner*—Edward K. Look
*Assistant Examiner*—John Ryznic
*Attorney, Agent, or Firm*—Fitzpatrick, Cella, Harper & Scinto

[57] ABSTRACT

A sheet-postprocessing apparatus includes a sheet discharger which discharges sheets to a stacker, the stacker including a first tray adjacent to the discharger for supporting trailing portions of the sheets discharged by the discharger and a second tray for supporting leading portions of the sheets, the second tray being movable in a vertical direction and disposed downstream of the first tray with respect to a sheet discharge direction, the trays being inclined so that sheets stacked thereon slide by their own weight, such that a stack of sheets supported on both trays are stapled by a stapler, the stapled set of sheets then being pushed out of the first tray to be stacked entirely by the second tray. The sheet post-processing apparatus operates in two modes, a stapling mode and a non-stapling mode wherein sheets discharged by the discharger bypass the first tray and are supported entirely by the second downstream tray.

21 Claims, 28 Drawing Sheets

SHEET POST-PROCESSING APPARATUS

This application is a continuation of application Ser. No. 08/033,974, filed Mar. 19, 1993, now abandoned, which is a continuation of application Ser. No. 07/772,131, filed Oct. 9, 1991, now abandoned, which is a continuation of application Ser. No. 07/364,476, filed Jun. 12, 1989, now abandoned.

FIELD OF THE INVENTION AND RELATED ART

The present invention relates to a sheet handing or sheet post-processing apparatus for binding sheets on which images are formed by an image forming apparatus.

In a conventional system, as is disclosed in Japanese Laid-Open Patent Application No. 78069/1984 (GB 2126997B) a sheet processing apparatus for aligning and stapling the sheets and an accommodation tray for accommodating the processed sets of stapled sheets are completely separate.

Japanese Laid-Open Patent Application No. 47760/1983 (U.S. Pat. No. 4,424,963) discloses that copy sheets are conveyed to a stapling station by a vacuum conveying system, and after the stapling, the copy sheets are pushed out to the adjacent accommodating apparatus.

However, in such a finisher apparatus, the vacuum conveying mechanism is disposed substantially above the sheet accommodating portion with the result that the vacuum conveyance passage to the stapling position and the passage for conveying out the stapled sheets are crossed. Therefore, the sheet accommodating portion is substantially completely covered by the conveyance passage, and it is not possible for an operator to check, during the processing operation, the images on the copy sheets and properness of the stapling. It is only after all the copy processing steps are completed that the operator can check the image density, properness of the sheet alignment and the properness of the stapling. It is probable that the operator notes the possible inproperness only after all the process steps are completed.

Additionally, in order to make the apparatus capable of processing full size sheets (A3 size, or LGL size or the like), the accommodating portions has to be correspondingly expanded with the result of expansion of the conveying portion. This makes the apparatus bulky and expensive.

Furthermore, in the conventional sheet finishing or post-processing apparatus, sets of bound sheets are continuously fed to and stacked on the same position on the accommodation tray, and therefore, when the sheets are stapled by a stapler, the stapled portions of the sheets are overlaid, so that the stapled portions of the sets of sheets result in locally thicker portion of the stack. Therefore, if the number of the sets in the stack is large, the stack is easily destroyed.

The apparatus disclosed in the Japanese Laid-Open Patent Application No. 47760/1983 is provided with side walls around the accommodating tray. However, the structure wherein the stack is prevented from destroying, the sizes of the sheets have to be the same. In addition, when the sheets are aligned or stapled with a part thereof on a stapled set of sheets, the larger thickness at the stapled portion prevents proper alignment and stapling.

Japanese Laid-Open Utility Model Application No. 195138/1984 discloses that a discharged sheet receiving tray for an image forming apparatus is provided with a manually operable stapler which is manually displaceable along an edge of the sheets.

However, this conventional apparatus is cumbersome in operation since the stapler is manually operated and displaced. It would be considered that the stapler is displaced by electric motor, with the result, however, of bulkiness of the apparatus. Particularly when an attempt is made to displace an electric stapler with electric power, greater power is required to displace it since the electric stapler itself has a considerable weight. In addition, the power consumption, cost, size and noise of the apparatus are increased.

SUMMARY OF THE INVENTION

Accordingly, it is a principal object of the present invention to provide a sheet post-processing apparatus by which sheets are stapled in good order.

It is another object of the present invention to provide a sheet post-processing apparatus in which sets of bound sheets are easily and assuredly stacked.

In one aspect of the present invention, there is provided a sheet post-processing apparatus comprising discharging means for discharging sheets, stacking means for stacking the sheets discharged by the discharging means, a limiting plate for limiting position of upstream edges of the sheets stacked on the stacking means with respect to a sheet discharging direction, moving means for moving the bound sheets toward downstream from the stacking means, and accommodating means capable of moving downwardly, for accommodating the sheets moved from the stacking means by the moving means, said accommodating means constituting a part of said stacking means.

In this apparatus, the size of the stacking means for stacking the bound sheets can be reduced, and therefore, the apparatus does not become so bulky even if it is capable of handling large size sheets. The sheets accommodated in the accommodating means can be observed by the operator without difficulty, and therefore, erroneous copying and erroneous stapling can be found immediately.

According to another aspect of the present invention, a set or sets of stapled sheets are stacked with deviation so that the stapled portions are not overlaid. With this structure, the stack is not easily destroyed even if the number of sets is large. In addition, the obstruction to the stacking of the next sheet due to the locally thick portion at the stapled parts, can be avoided.

According to a further aspect of the present invention, the sheets are moved to the binding position, by which the sheets can be bound or stapled at selected position or positions without increase the power consumption, noise, cost and size.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Description will be made in conjunction with the accompanying drawings with respect to the preferred embodiments of the present invention.

Figure 1:
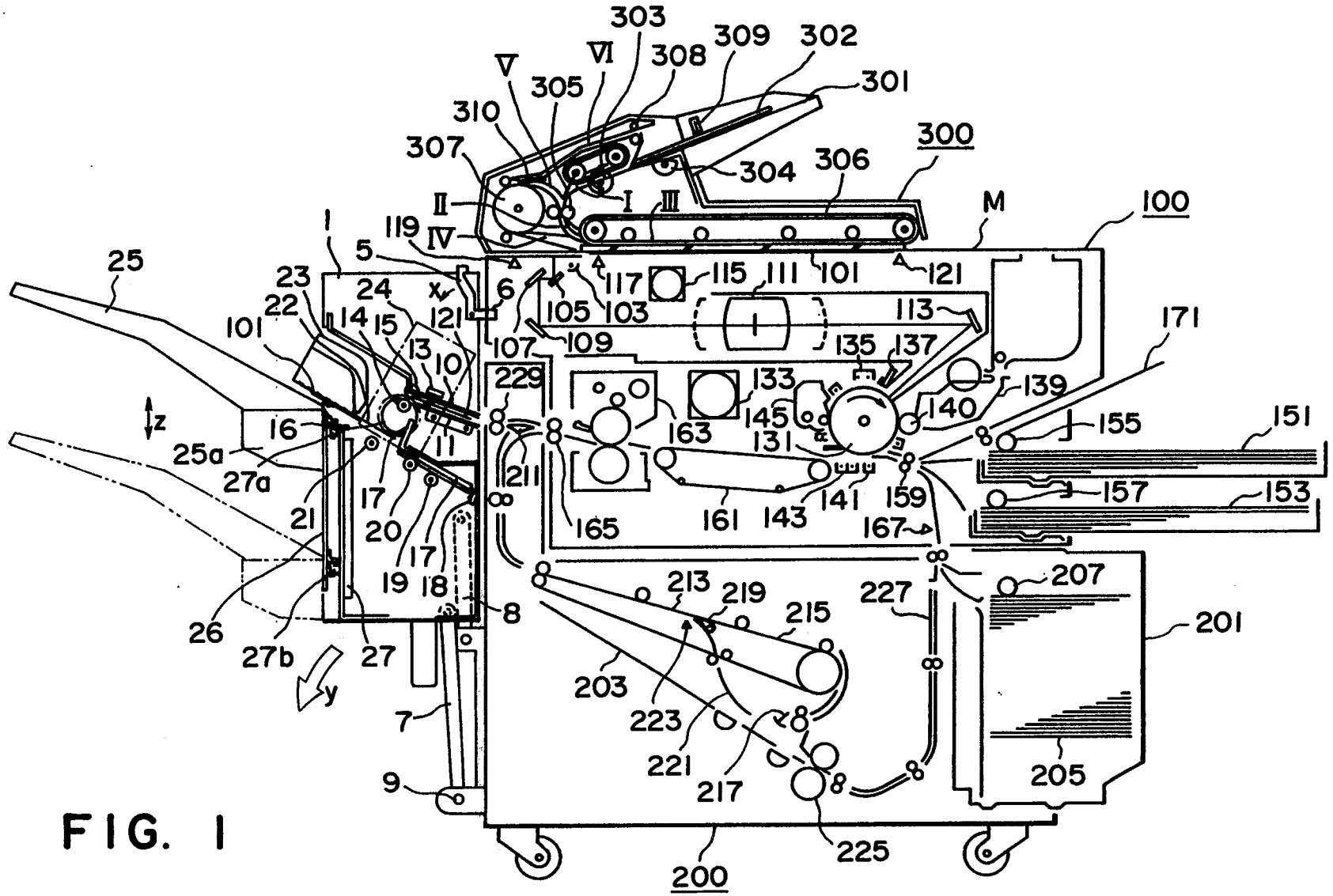
FIG. 1 is a sectional view of an image forming apparatus provided with a sheet post-processing apparatus according to an embodiment of the present invention.

Referring to FIG. 1, there is shown an internal structure of a copying apparatus according to an embodiment of the present invention.

The apparatus comprises a sheet post-processing apparatus 1, a main assembly 100 of the copying apparatus, a pedestal 200 having a duplex processing function for inverting a recording medium (sheet) upon duplex copying and/or a function of superposing recording wherein plural image recording operations are performed on the same recording medium, and a recirculation type original feeder, which will hereinafter be called "RDF" for automatically feeding original documents.

A. Main assembly (100)

The main assembly 100 includes an original supporting platen glass. 101 for supporting an original to be copied, an illumination lamp (exposure lamp) 103 for illuminating the original, a reflection mirror (scanning mirror) 105, 107 and 109 for folding the optical path for the light reflected by the original, a variable magnification imaging lens 111, a fourth reflection mirror (scanning mirror) 113 for folding the optical path. It also comprises a motor 115 for driving an optical system, and sensors 117,119 and 121.

In the main assembly 100, there are a photosensitive drum 131, a main motor 133 for driving the photosensitive drum 131, a high voltage unit 135, a blank exposure unit 137, a developing device 139, a developing roller 140, an image transfer charger 141, a separation charger 143 and a cleaning device 145.

The apparatus further comprises an upper cassette 151, a lower cassette 153, a manual feed opening 171, sheet feeding rollers 155 and 157 and a registration roller 159. It further comprises, a sheet conveying belt for conveying to an image fixing station recording material having received the image, an image fixing device 163 for fixing the image on the recording sheet conveyed thereto by heat and pressure, and a sensor 167 which is used when duplex copying operation is carried out.

The recording or transfer sheet accommodated in the upper cassette 1.51 or the lower cassette 153 or set in the manual feeder opening 177, is fed into the main apparatus by the feeding rollers 155 or 157, and is directed to the photosensitive drum 131 with a correct timed relation with the photosensitive drum by the registration roller 159, so that the leading edge of the latent image on the photosensitive drum 131 and the leading edge of the transfer sheet are aligned. Subsequently, the toner image on the photosensitive drum 131 is transferred onto the transfer sheet by the transfer sheet passing between the transfer charger 141 and the photosensitive drum 131. After the image transfer operation, the transfer sheet is separated from the drum 131 by a separation charger 143, and is introduced into the image fixing device 163 by the conveying belt 161. In the fixing device, the toner image is fixed on the transfer sheet by pressure and heat. Thereafter, the sheet is discharged out of the main assembly 100 by the discharging roller 165.

After the image transfer, the photosensitive drum 131 continues its rotation and is cleaned on its surface by the cleaning device 145 constituted by a cleaning roller and an elastic blade.

B. Pedestal (200)

The pedestal 200 is separable from the main assembly 100 and is provided with a deck 201 capable of accommodating 2000 transfer sheets and with an intermediate tray 203 for duplex copy. A lifter 205 of the deck 201 moves up in accordance with the amount of the transfer sheets on the deck so that a transfer sheet is always in contact with the feeding roller 207.

The pedestal 200 comprises a sheet discharge flapper for switching between duplex recording or superposing recording passage and the discharging passage, conveyance passages 213 and 215 for the conveyance by the conveying belt, a weight 217 for confining the transfer sheet for the intermediate tray. The transfer sheet passing through the flapper 211 and the conveying passages 213 and 215 is inverted in its facing orientation and is accommodated in the intermediate tray 203 for the duplex copy. A flapper 219 functions to switch between the passage for the duplex copy and the passage for the superposing copy, and is disposed between the passage 213 and the passage 215. When it rotates upwardly, the transfer sheet is directed to the passage 221 for the superposing recording. A superposed copy discharge sensor 223 is effective to detect a trailing edge of the transfer sheet passing by the flapper 219. A feeding roller 225 serves to supply the transfer sheet to the drum 131 through the passage 227. Discharging rollers 229 is effective to discharge the transfer sheet outside the pedestal.

Upon duplex recording (duplex copying) operation or superposing recording (superposing copy) operation, the discharge flapper 211 of the main assembly 100 takes its upper position to direct the copy sheet into the intermediate tray 203 through the passages 213 and 215 of the pedestal 200. When the duplex recording mode is selected, the flapper 219 takes its lower position, whereas when the superposing recording is selected, the flapper 219 takes its upper position. The intermediate tray 203 can accommodate 99 copy sheets, for example. The transfer sheets accommodated in the intermediate tray 203 are confined by the intermediate tray weight 217.

For the second image recording for the duplex or superposing recording, the transfer sheet accommodated in the intermediate tray 203 is directed to the registration roller 159 of the main assembly 100 one by one from the bottom through the passage 227 by the functions of the feeding roller 225 and the weight 217.

C. RDF (Circulation Type Document or Original Feeder) (300)

In the document feeder 300, a stacking tray 301 is provided on which a set of originals 302 is stacked. Where the originals are simplex, the originals are separated one by one from the bottom by crescent roller 304 and a separation roller 303. The separated document is conveyed by the conveying roller 305 and a whole surface belt 306 to an exposure position on the platen glass 101 through passages I-II, and is stopped there. Subsequently, the copying operation is started. After completion of the copying operation, it is conveyed to a passage VI through a passage IV by a large conveying roller 307, and is returned to the top of the set of documents by a discharging roller 308. A recycle lever 309 detect one circulation of the original document. It is placed on the top of the set of originals at the time of the original feed start and it falls when the trailing edge of the last original document passes by its, by its own weight, by which one circulation of the original is detected.

Next, when the originals are duplex ones (having images on both sides), the original is once directed through passages I and II to the passage III in the manner described above. The rotatable flapper 310 is switched, and the belt 306 is reversed so that the leading edge of the original is directed to the passage IV. The original document is conveyed to the platen glass 101 by the conveying roller 305, through the passage II and by the whole surface belt 306, and is stopped there. In brief, the original is inverted in its facing orientation by the large conveying roller 307 through the passages III-IV-II.

The number of the original documents can be counted by conveying one by one the documents constituting the set 302 through the passages I-II-III-IV-VI until one circulation is detected by the recycle lever 309.

D. Sheet Post-Processing Apparatus

The sheet post-processing apparatus is designated by a reference numeral 1. It is coupled with the main assembly of the image forming apparatus firstly by a locking arm 5 formed on the top of the sheet post-processing apparatus I positioned with respect to and engaged with a holding portion 6 in the main assembly of the image forming apparatus. Further, below the sheet post-processing apparatus 1, a linkage unit is constituted by a lower link 7 and an upper link 8 to support the body I of the apparatus 1. At a pivot 9 of the lower link, there is a torsion bar to normally urge the lower link 7 in the clockwise direction about the pivot 9. When a trouble in the sheet conveyance (jam) occurs in the main assembly 100 or in the sheet post-processing apparatus 1, and the sheet in the apparatus has to be taken out, the locking arm 5 is rotated in the direction x to move the apparatus away in the direction y, during which the weight of the entire apparatus is partly offset by the torsion bar, thus facilitating mounting and dismounting operation of the post-processing apparatus relative to the image forming apparatus.

The copy sheet discharged from the discharging portion of the image forming apparatus is conveyed toward downstream by the sheet passage 12 constituted by an upper guide 10 and a lower guide 11 of the sheet post-processing apparatus. A sheet detecting sensor 13 is effective to detect the passing sheet and the stagnating sheet. Designated by a reference numeral 14 is a lower roller for discharging the sheet to the tray; 15, a confining roller° A discharge alignment belt 16 extends through a nip formed between the lower roller 14, and the confining roller 15 and is revolved thereby. Although not shown, an endless rib is formed on the inside of the belt at its central portion to prevent disengagement of the belt to assure engagement with the lower roller 14. An abutment plate 17 functions as a reference surface for aligning copy sheets, and it substantially determines the stapling position. At the home position of the abutment plate 17, a microswitch 18 is disposed to normally stop its at one position. A rack formed on the bottom surface of the abutment plate and is movable in the direction of the sheet conveyance and in parallel with a fixed stacking portion 22 by a first roller 19, a pinion 20 and a second roller 21. The pinion 20 serves to drive the abutment plate 17 and is driven by an unshown motor. The first roller 17 and the second roller 21 function to confine abutment plate 17 for its translational movement. By constructing the abutment plate 17 so that it can be positioned at a desired position, for example, by driving the abutment plate 17 by a stepping motor or the like and controlling the stop position of the abutment plate on the basis of the number of pulses counted from the home position, it is possible to change the stapling position on the copy sheets. A positioning plate 23 serves to provide an abutment reference for aligning the copy sheets in the direction perpendicular to the sheet conveyance (lateral direction).

In this embodiment, the lateral alignment of the sheets are accomplished by an aligning belt 102 (FIG. 2) which will be described hereinafter. In the region 24 defined by chain lines in FIG. 1, a stapler unit is disposed. In this description of the embodiment, the detailed description of the stapler unit is omitted, but it may be of a commercially available type driven by solenoid or motor to staple the sheets.

An accommodation tray 25 accommodates the sheets and also functions as a movable stacking member of this embodiment of the present invention. The accommodating tray 25 is driven by a driving source (which will be described hereinafter) contained therein at a bottom portion 25a, for movement in the vertical direction (z) and a lateral direction (x, in FIG. 2). A regulating plate 26 is effective as a positioning stopper by contact with trailing edges of the accommodated sheets when the accommodating tray 25 moves down. It is supported by guiding rollers **27*a* and 27*b* mounted on a stay 27** of the sheet post-processing apparatus, and therefore, it is movable in the lateral direction together with the accommodating tray. By this, the bound or stapled copy sheets on the accommodating tray are movable relative to the fixed stacking portion (or the sheet discharging position) without deviation when the tray is moved in the lateral direction.

The detailed description will be made as to the structural elements not covered by FIG. 1 (sectional view), referring to FIG. 2.

Figure 2:
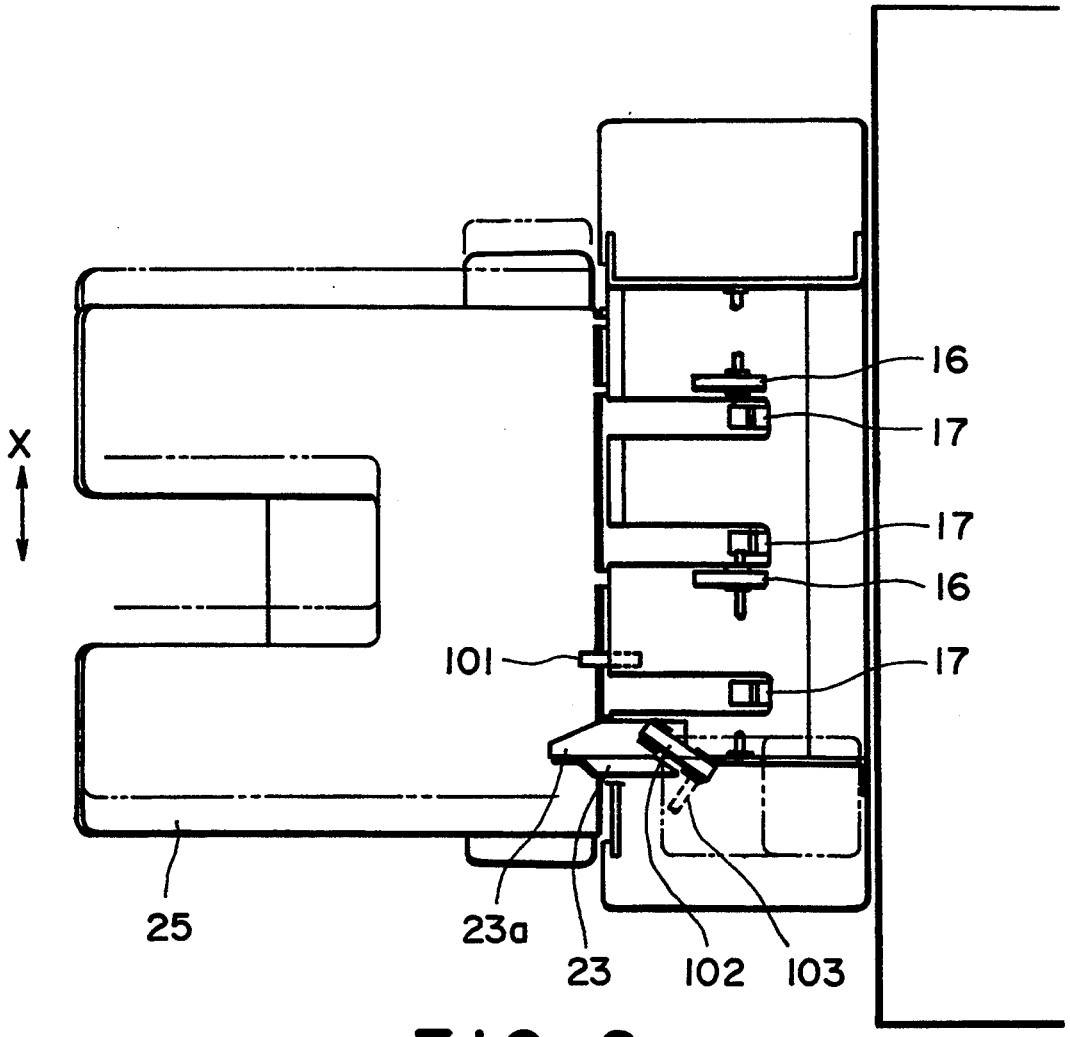
FIG. 2 is a top plan view of the sheet post-processing apparatus.

FIG. 2 is a top plan view of a lower part of the vertically divisible sheet passage 12 of the sheet post-processing apparatus 1 according to an embodiment of the present invention. A level detecting arm 101 for the accommodating tray detects the level of the copy sheets after the processing and constitutes a part of control means for making the level of the accommodation tray 25 with the sheets accommodated the same as the fixed stacking portion 22. Referring to FIG. 6, designated by a reference 501 is a microswitch. A second aligning belt 102 cooperates with the discharge alignment belt 16 to forcedly shift the copy sheet to the alignment reference (lateral direction). More particularly, edges of the copy sheets are abutted to the positioning plate 23. The second aligning belt 102 is driven by an unshown motor. The discharged copy sheet jumps over the lateral alignment function portion (aligning belt 102) and is received by the tray, and then it falls by its weight, and is retracted by the discharge aligning belt 16 and 102 from the sheet edge. The second aligning belt 102 is supported on a rotational driving shaft 103, and during the copy sheet being discharged, it is in contact with the top surface of the tray lower portion **23*a* of the positioning plate 23**.

On the contrary, while the copy sheets are pushed out, the tray surface and the second aligning belt 102 are spaced apart by a solenoid or the like through an unshown linkage.

Figure 3:
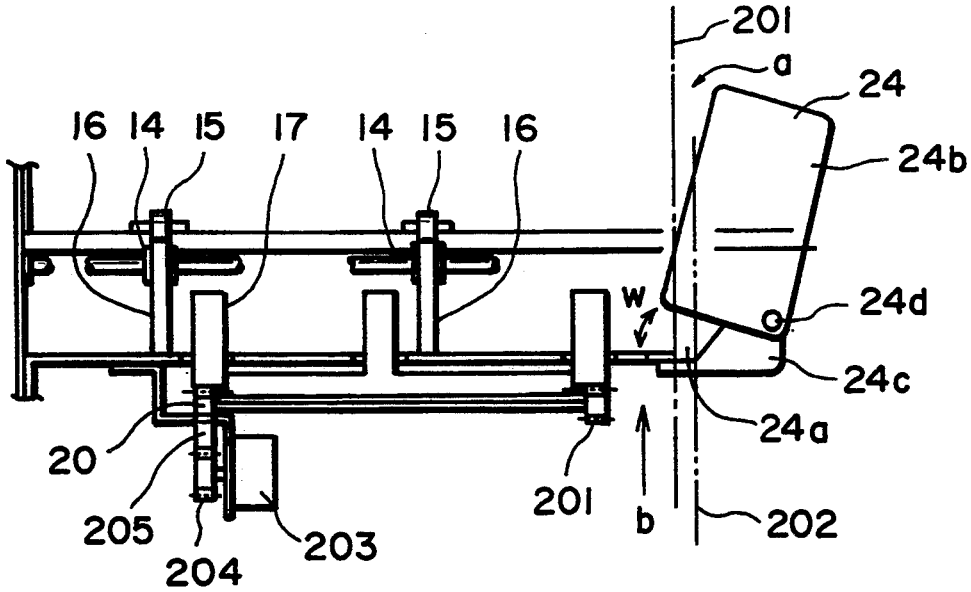
FIG. 3 is a front view of a major part of the sheet post-processing apparatus.

Referring to FIG. 3, there is shown a front view of a tray discharging portion. A chain line 201 designates an edge reference position of the discharged copy sheet, and the stapling unit 24 is normally disposed outside the edge of the discharged sheet. The discharged sheet is abutted to the positioning plate 23 by the second aligning belt 102, and therefore, after the discharged sheet is received by the tray surface, it is retracted to the stapler opening 24a indicated by a chain line 202. Thus, the position of the line 202 is a lateral alignment reference position and therefore a stapling reference position. In the stapler unit 24, an upper unit **24*b* rotates about a shaft 24*d* in a direction indicated by an arrow a, and a lower unit 24*c* rotates about a shaft 24*d* in a direction b, thus stapling the sheets. The abutment plate 17 is driven by a driving motor 203 which drives the pinion 20 through gears 204 and 205**.

Figure 4:
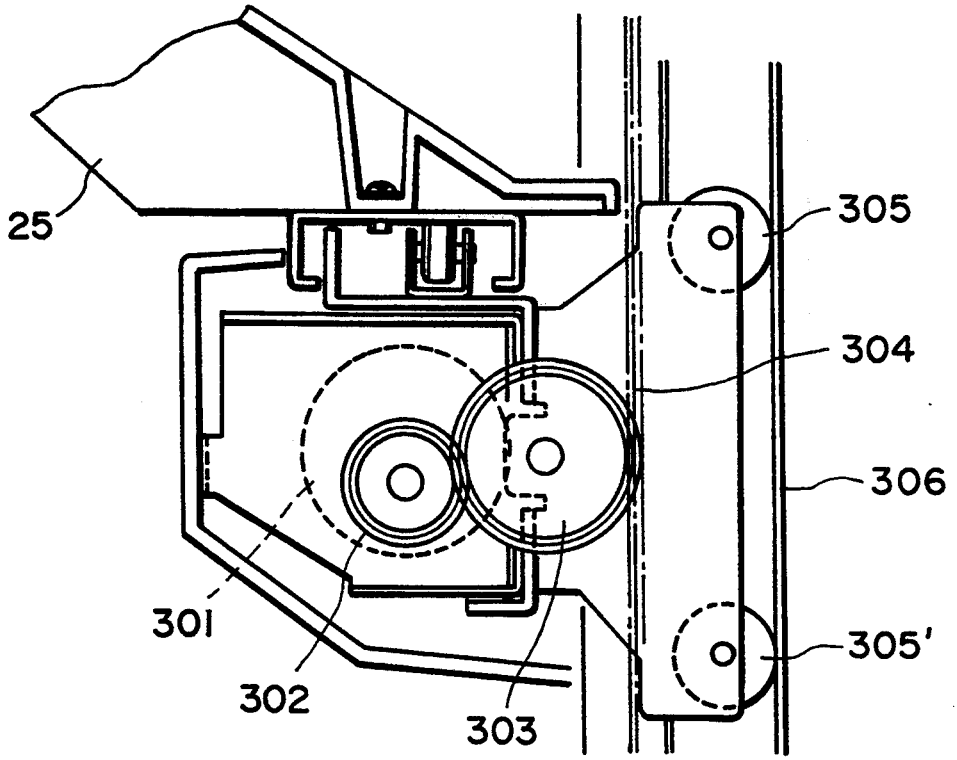
FIG. 4 is an enlarged sectional view of an accommodating tray of the sheet post-processing apparatus.

FIG. 4 shows a built-in driving section in the lower portion **25*a* of the tray. A motor 301 functions for the vertical movement, and the driving force is transmitted to a pinion 303 through a gear 302, and the pinion 303 is meshed with a rack 304 fixed on a side plate of the main assembly, thus permitting the vertical movement of the accommodating tray 25. The guiding rollers 305 and 305' are mounted on a unit in the lower portion 25*a* of the accommodating tray, so that smooth movement is assured along a guiding rail 306 fixed on the side plate of the main assembly. The weights of the accommodating tray itself and the copy sheets accommodated therein are received by the guide rail 306**.

Figure 5:
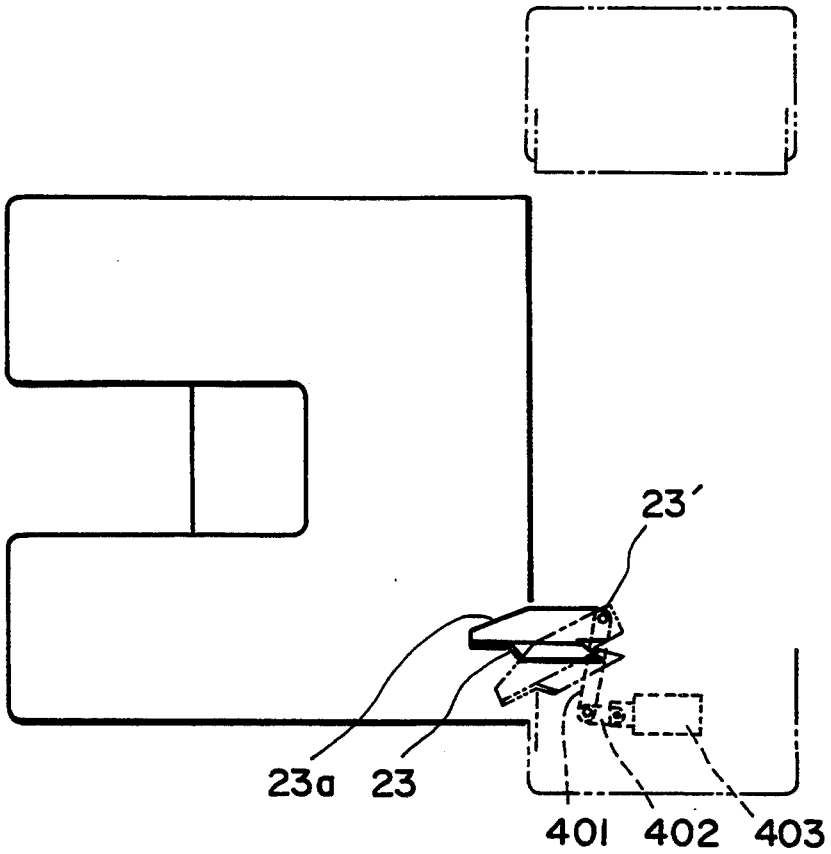
FIG. 5 is a somewhat schematic top plan view of the accommodating tray.

FIG. 5 illustrates movement of the positioning plate 23. The positioning plate 23 is fixed during the copy sheet being discharged in order to function as a lateral abutment reference surface, but when the copy sheets are pushed into the accommodating tray by the abutment member 17 after completion of a cycle of copy, it moves to allow the trailing edges of the sheets on the lower supporting plate **23*a* on the accommodating tray 25. In this embodiment, full size sheets (A3, B4 or the like) which has a longer side in the direction of the sheet conveyance, can be accommodated. Since the abutment surface of the positioning plate 23 is extended to the top of the accommodating tray 25, the above structure is employed. However, if the apparatus is designed only for half size sheet such as A4 size sheet, the positioning plate 23 may have a shorter length, and it can be disposed in the fixed stacking portion 22, so that the mechanism for the rotational movement may be omitted. In this embodiment, an arm 401 is fixed to the positioning plate 23 adjacent the pivot 23', whereby the positioning plate 23 is rotated by an attraction force of a solenoid 403 through a linkage 402**, as shown by chain lines.

Figure 6A:
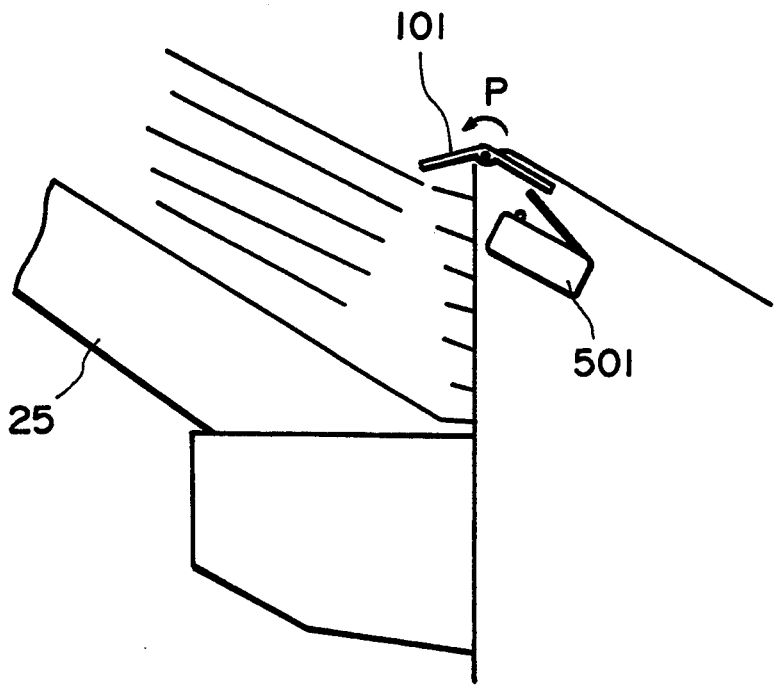
FIGS. 6A and 6B illustrate operation of the accommodating tray.
Figure 6B:
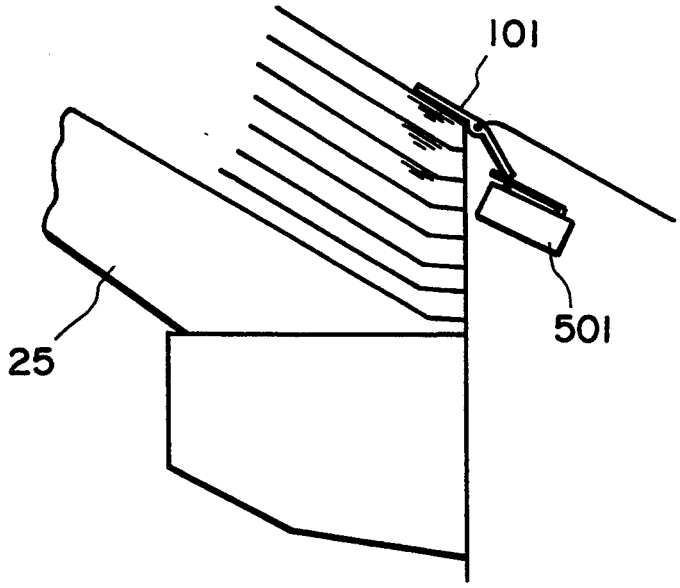

FIGS. 6A and 6B schematically illustrate the level sensor adjacent an end of the accommodating tray. FIG. 6A shows the tray while it is moving downwardly. When this state is reached, a microswitch 501 is deactuated, and then, the accommodating tray 25 is moved up so as to actuate the microswitch shown in FIG. 6B.

The level detecting arm 101 is normally urged in the counterclockwise direction (P direction in FIG. 6) by an unshown spring means.

The fixed stacking portion 22 and the accommodating tray 25 are inclined toward downstream with respect to the sheet discharging direction. The aligning belt 16 rotating together with the tray discharge lower roller 14 is in contact with the fixed stacking portion 22. When the sheet is stacked on the fixed stacking portion 22, the aligning belt 16 is contacted to the sheet to drive it toward the abutment plate 27. Similarly, the second alignment belt 102 rotates while being in contact with the sheet on the fixed stacking portion 22 to shift the sheet toward the positioning plate 23.

Figure 8:
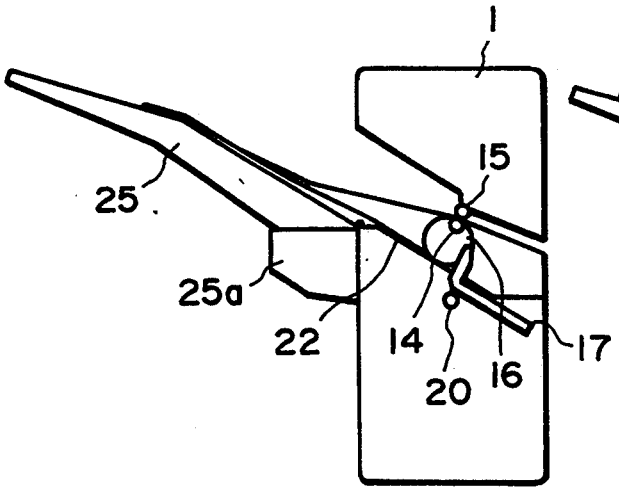
FIGS. 8–12 illustrate operation.

By the end of the timer period of the tray accommodating timer, the sheet received by the fixed stacking portion 22 is aligned by the inclination of the accommodating tray 25, the aligning belt 16 and the second aligning belt 102 so that the trailing edge and a lateral edge of the sheet are abutted to the abutment plate 27 and the positioning plate 23, respectively (FIG. 8).

E. Control Device (800)

Figure 7:
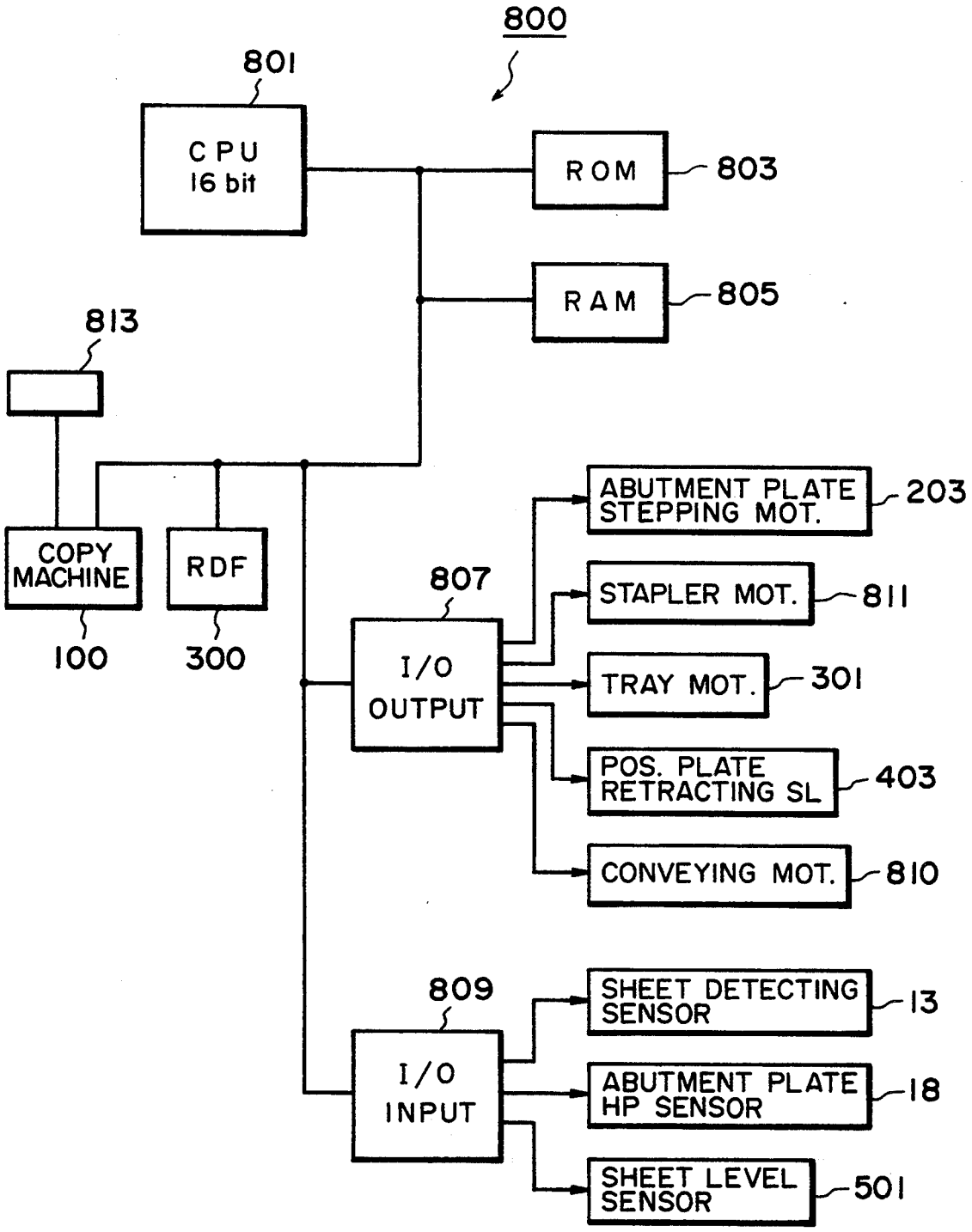
FIG. 7 is a block diagram of a control system.

FIG. 7 illustrates a control device 800 for the apparatus of FIG. 1 embodiment. The control device includes a central processing unit (CPU) for performing various processing operation for the apparatus of the present invention, a read only memory (ROM) storing the control sequence (control program) shown in FIGS. 13 and 14. The CPU 801 controls various elements connected to the control device by bus lines in accordance with the control sequence stored in the ROM.

The control device further includes a random access memory (RAM) which is main memory used to store the input data or to store various operational data.

An interface (I/O) 807 is effective to output control signals from the CPU 801 to the loads such as the tray vertical movement motor 301 or the like. An interface 809 is used to receive the signals from the sheet detecting sensor 13 or the like and to transmit it to the CPU 801. Copying modes are inputted on a key board 813.

An example of operation of the apparatus according to this invention will be described in conjunction with FIGS. 8–12, 13 and 14.

Figure 13:
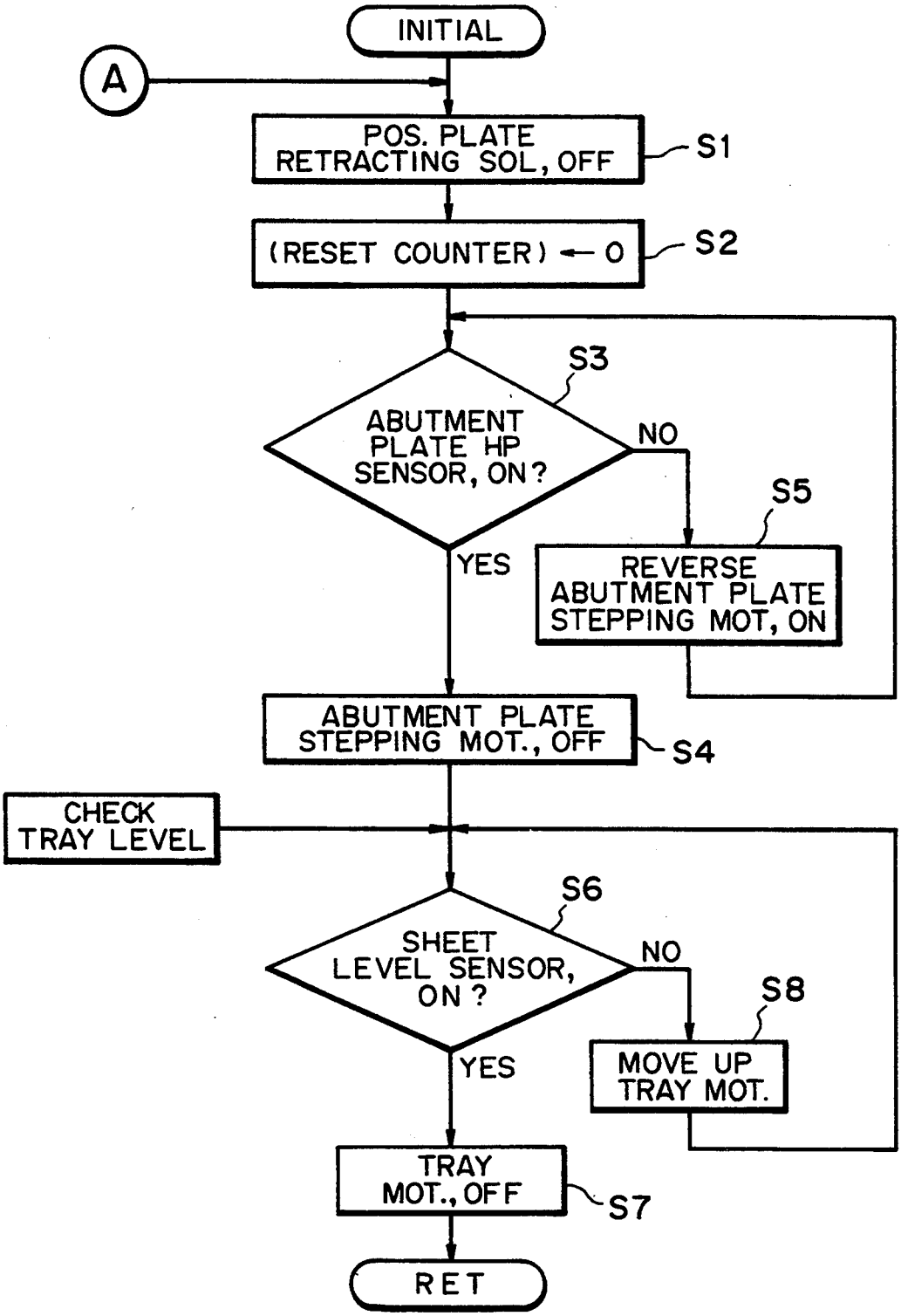
FIGS. 13 and 14 are flow charts illustrating operation of the apparatus.

FIG. 13 is a flow chart for the initial operations of the post-processing apparatus which is performed at the time when the main switch is actuated or when the copy start button is actuated. At a step S1, the solenoid 403 for retracting the positioning plate 23 is deenergized to place it at the stapling position (solid line in FIG. 5). At step S2, the accommodated number counter (it will be described hereinafter) is reset to 0. At steps S3–S5, the stepping motor 203 is actuated for its reverse rotation until the abutment plate 17 returns to its home position, and when it reaches the home position, the stepping motor 203 is stopped.

At steps S6–S8, the level of the tray is checked, and the tray vertical movement motor is actuated for the upward movement until the sheet level sensor (microswitch 501) is actuated, and then, it is stopped. Through the process steps S1–S8, the tray becomes prepared for receiving the sheets discharged from the copying apparatus.

Figure 14A:
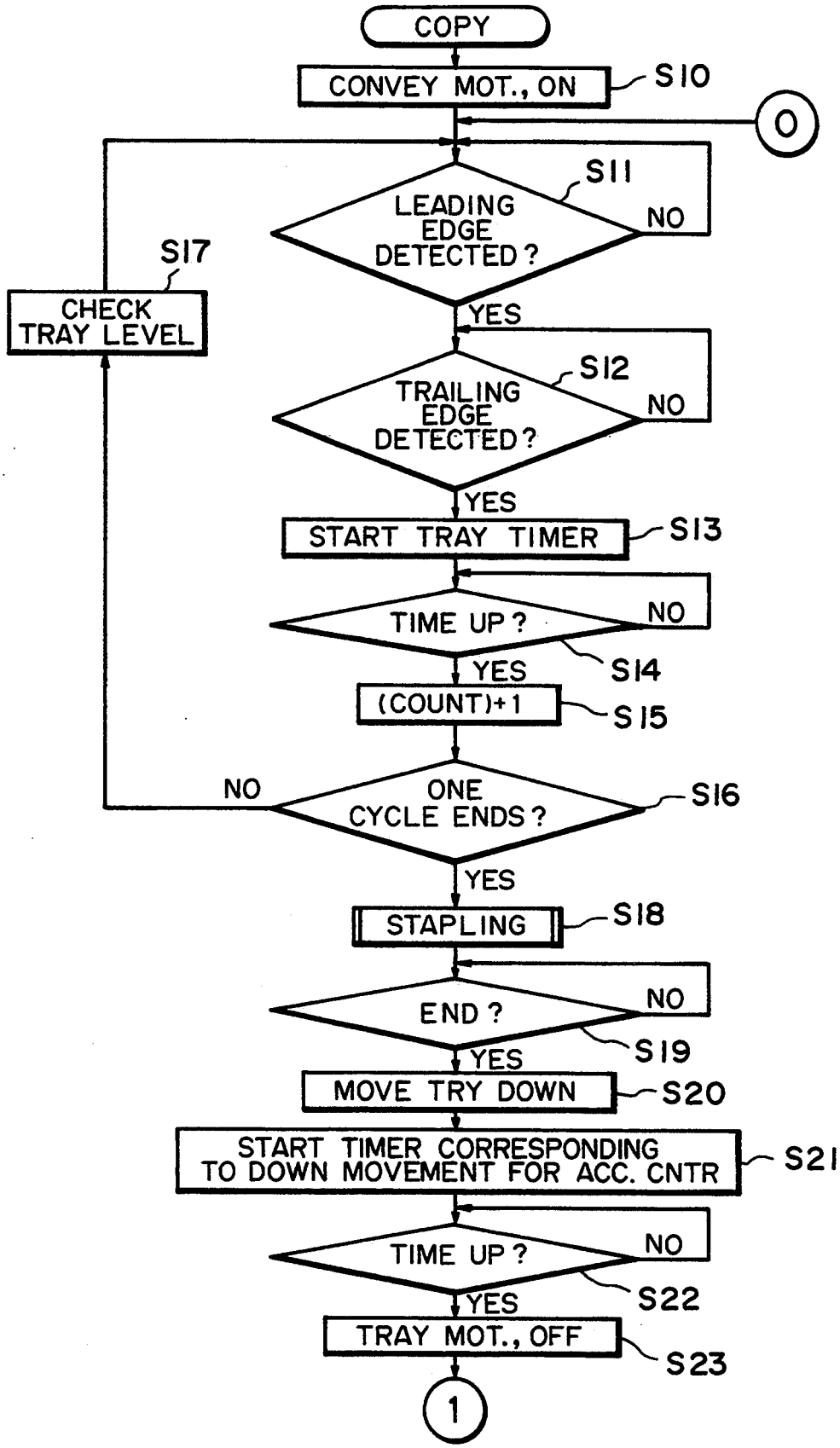
Figure 14B:
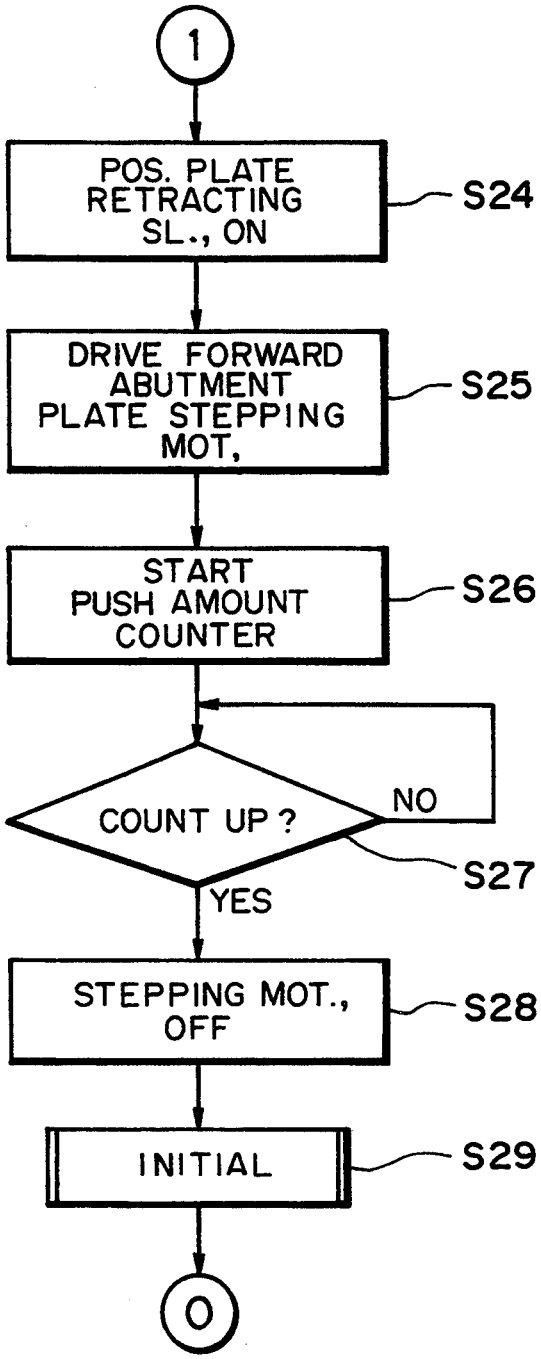

FIG. 14 is a flow chart showing the sheet processing operation after the copy start. At step S10, the conveying motor 801 for driving the tray discharge lower roller 14 (FIG. 7) is energized. After the sheet detecting sensor 13 detects the leading edge of the sheet at step S11, the tray accommodating timer is started at step S13 upon detection of the sheet trailing edge at step S12. The sheet confined by the lower roller 14 and the roller 15 falls on the fixed stacking portion 22 and an accommodating tray 25. Upon the end of the tray accommodating timer period (S14), a sheet is accommodated on the tray, and the accommodated number counter is incremented by +1 at step S15. Then the discrimination is made as to whether one cycle of copy processing is completed or not at step S16. This checking may be accomplished by the signal indicative of the one circulation of the original document using the recycle level 309 of the RDF. If the one cycle is not completed, the tray level is checked by the level detecting sensor 501 at step S17. If the operator takes the sheets out of the tray, the tray is moved upwardly so as to maintain the level of the sheet receiving surface.

Figure 9:
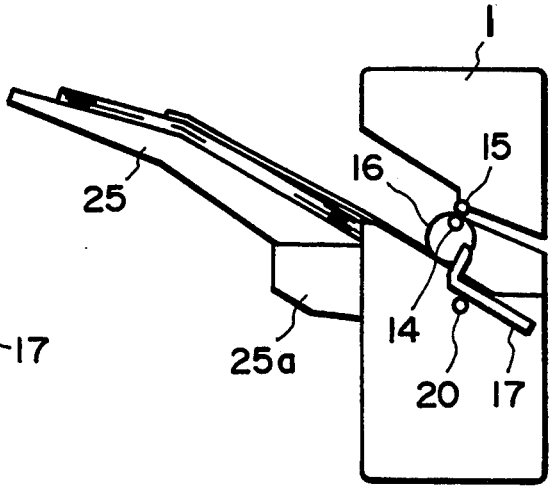

If the completion of the one cycle of the copy at step S16, the stapling motor 811 is actuated at step 518 to staple the sheets by the stapler unit 24. When the one cycle of the copy is not completed, the sequence goes back to the step S11 to receive the next discharged sheet and align it (FIG. 9).

Figure 10:
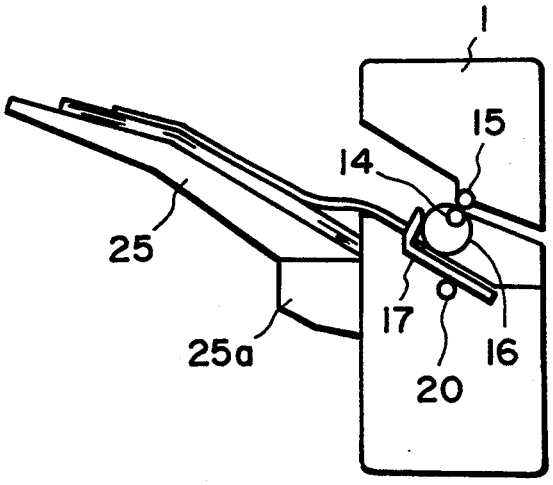
Figure 11:
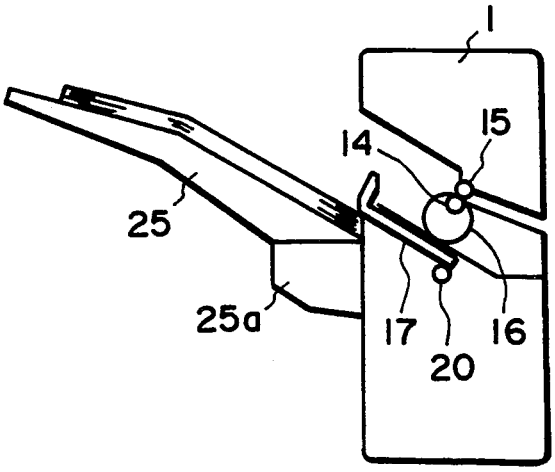
Figure 12:
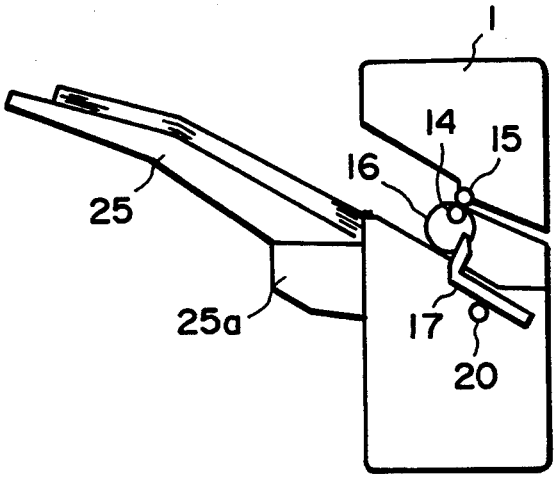

At step S18, the sheets are stapled, and at step S19, the completion of the stapling operation is awaited. Upon the completion, the tray motor 301 is actuated for the downward movement at step S20. At step S21, the timer having the timer period corresponding to the lowering amount in accordance with the number of the accommodated number count, and after the end of the timer period (S22), the tray motor 301 is deactuated at step S23. This is shown in FIG. 10. The timer period is set so as to be slightly larger than that corresponding to the number of sheets. For example, when the thickness of one sheet is 0.1, and the counts is 10, the lowering distance is 2 mm; when the count is 20, the lowering distance is 3 mm. At step S24, the positioning plate retracting solenoid 403 is actuated; at step 25 the abutment plate stepping motor 403 is actuated for the forward rotation; at step S26 a pushing amount counter is actuated; at step S23, the completion is awaited; and at step S28, the motor is deactuated. By the steps S25–S28, the abutment plate 17 is moved from the state shown in FIG. ! 0 toward the accommodating tray by the pinion 20, so that the stapled sheets are pushed out onto the accommodating tray 25 as shown in FIG. 11. In order not to obstruct the stapled sheets from falling by the abutment plate side edges of the sheets being interfered with the lower supporting plate 23*a* of the positioning plate 23, the positioning plate is retracted by the solenoid 403 to a position shown by chain lines in FIG. 5. After the stapled sheets are pushed out, the above described initializing process is performed at step S29 in accordance with the flow chart shown in FIG. 13, so that the positioning plate and the abutment plate are returned to their initial positions. In addition, at the steps S20–S23 described in the foregoing, the tray at a slightly lower level than that corresponding to the number of sheets is moved up until the level sensor 501 is actuated (S8), by which the fixed stacking portion 22 and the topmost surface of the newly stacked copy sheet are flush with each other. Then, the sequence goes back to step S11, and the next sheet discharge is awaited. According to the structure of this embodiment, by increasing the lowering amount of the accommodating tray, the number (capacity) of the continuously processable copy sheets is increased.

In addition, even if the set or sets of copy sheets accommodated already on the tray are taken out by the operator during the copying operation, the level detecting arm detects it to move tile tray up through the amount corresponding to the taken sheets, so that the topmost surface of the accommodated sheets are made flush with the fixed stacking portion.

In this embodiment, the abutment plate 17 is moved in order to move the stapled sheets from the fixed stacking portion 22 to the accommodating tray 25. However, another moving means may be provided. For example, a pushing member engageable with trailing edges of the sheet may be separately employed. As a further alternative, known sheet conveying means such as conveyer belt and conveying roller may be used.

Modification

Figure 15:
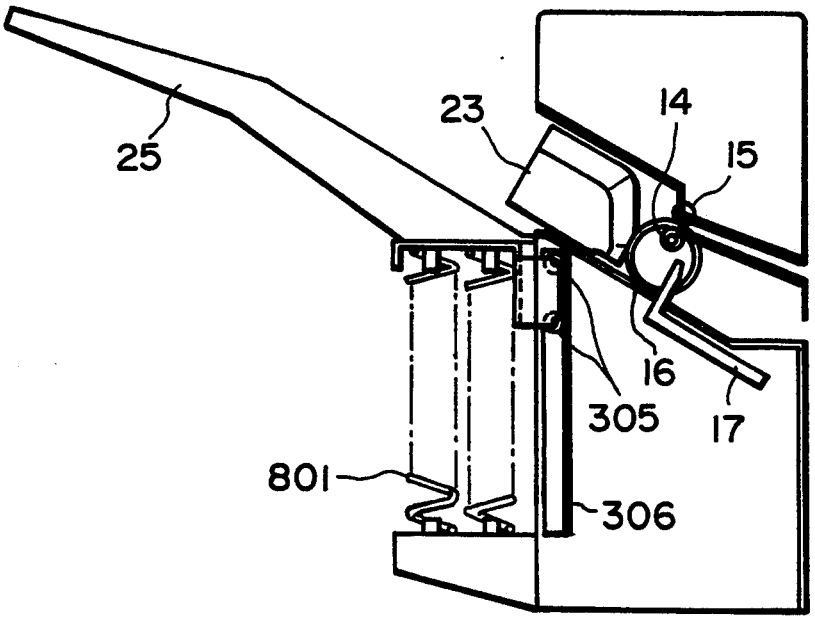
FIG. 15 is a sectional view of an accommodating tray of an apparatus according to another embodiment of the present invention.

In the foregoing embodiment, the vertical movement of the accommodating tray 25 is effected by a motor. In the present embodiment, however, as shown in FIG. 15, an elastic member 801 such as a spring is mounted to the bottom of the accommodating tray wherein the spring constant is selected so as to provide a balance with the weight of the sheet, so that the accommodating tray is movable downwardly by the weight of the copy sheets.

Figure 16:
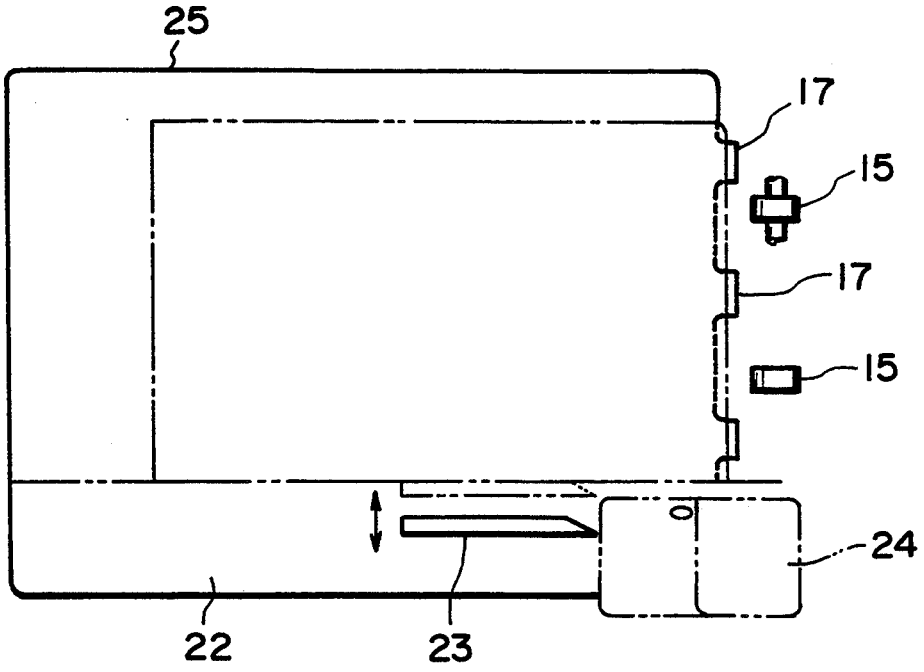
FIG. 16 is a top plan view of an accommodating tray of an apparatus according to a further embodiment of the present invention.

In the foregoing embodiments, the aligned and stapled copy sheets are pushed out in the direction of the sheet conveyance, but this is not limiting. For example, as shown in FIG. 16, they may be pushed out in a direction perpendicular to the sheet conveyance. In this case, since the stapler 24 is disposed at the front side in this embodiment the sheets are pushed rearwardly. If the stapler is disposed at the rear side, the sheets are pushed out frontwardly. And, the processed sheets are moved away from the stapler opening 24*a*, and the portion for receiving the moved sheets is constituted as a vertically movable accommodating tray 25. By doing so, the same functions can be provided. In this occasion, the lateral alignment abutment plate 23 is usable as a member for pushing the stapled sheets from the fixed stacking portion 22 to the accommodating tray 25.

Figure 17:
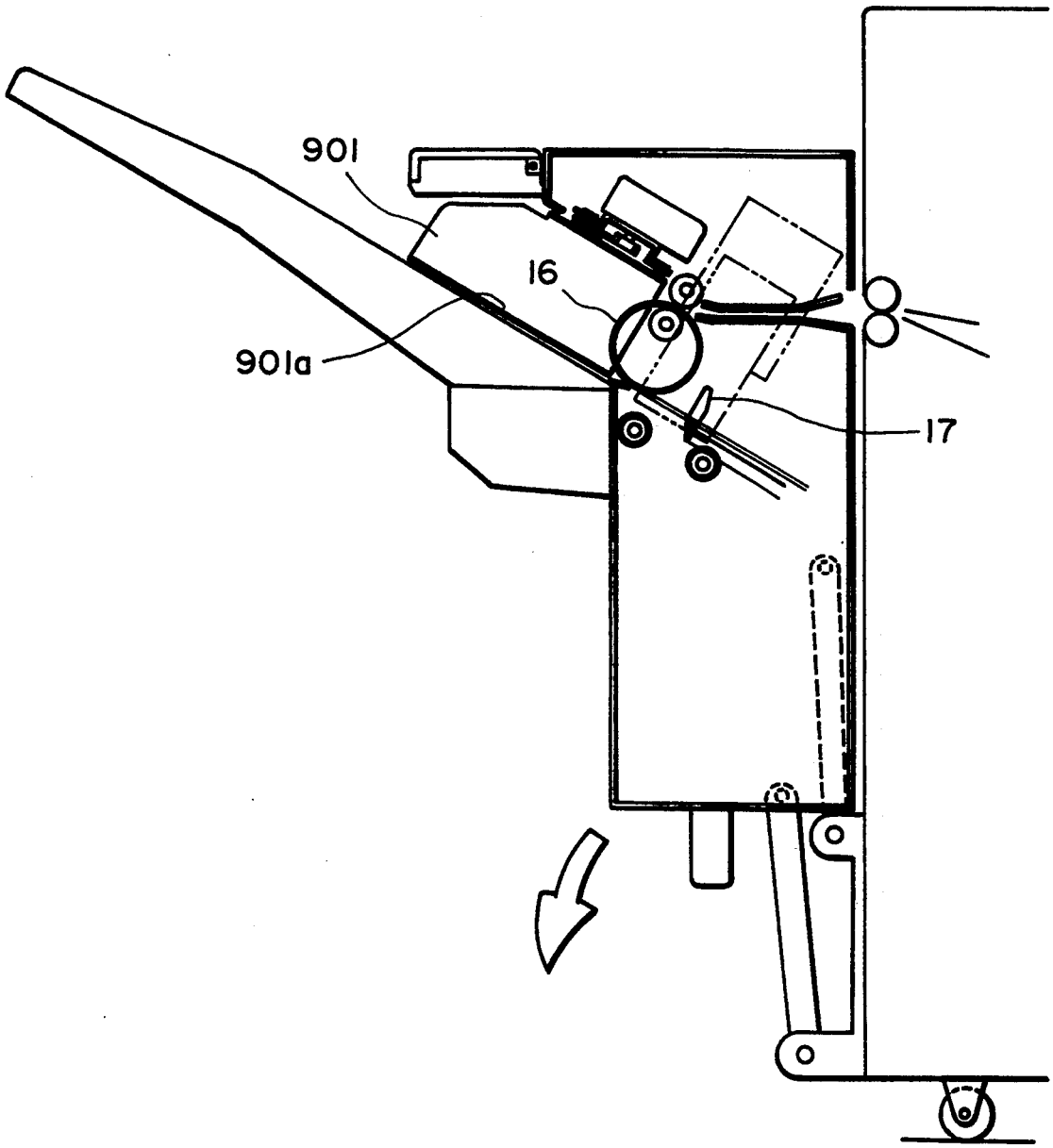
FIG. 17 is a sectional view of an accommodating tray of an apparatus according to a further embodiment of the present invention.
Figure 18:
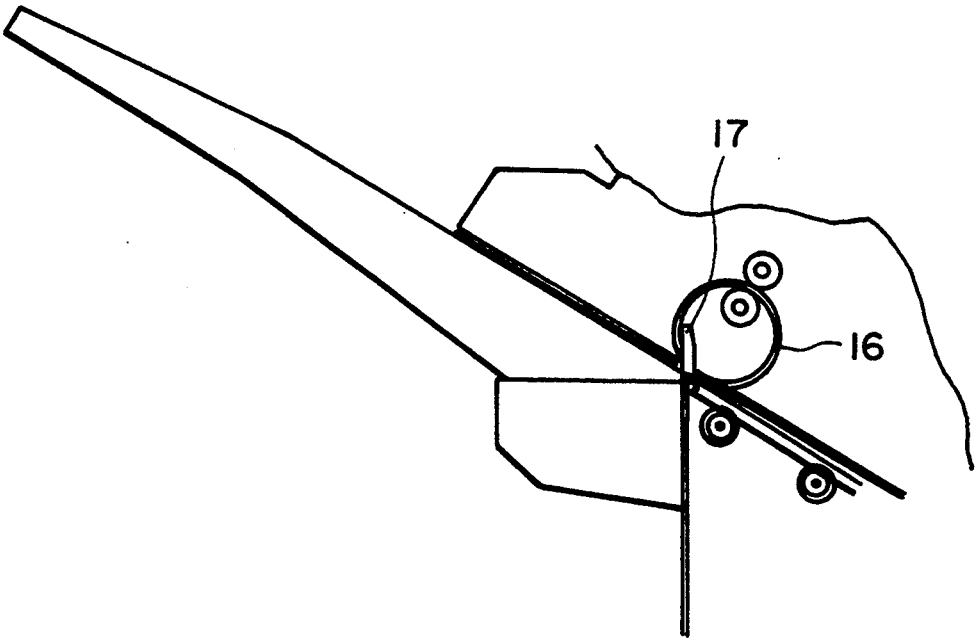
FIG. 18 illustrates operation of the apparatus.

In the foregoing embodiments, it is possible that the position of the aligning belt 16 is closer to the accommodating tray 25 (FIGS. 17 and 18). By doing so, at the time of the copy operation of non-stapling mode, as shown in FIG. 18, the sheet can be directly aligned and stacked on the accommodating tray 25 by the abutment plate 17 being moved toward the accommodating tray 25 and by positioning the sheet, without the pushing action. In this case, in the stapling mode, the abutment plate 17 is positioned at the stapling position shown in FIG. 17, similarly to the foregoing embodiments, and the sheets are pushed out after being stapled.

Figure 19:
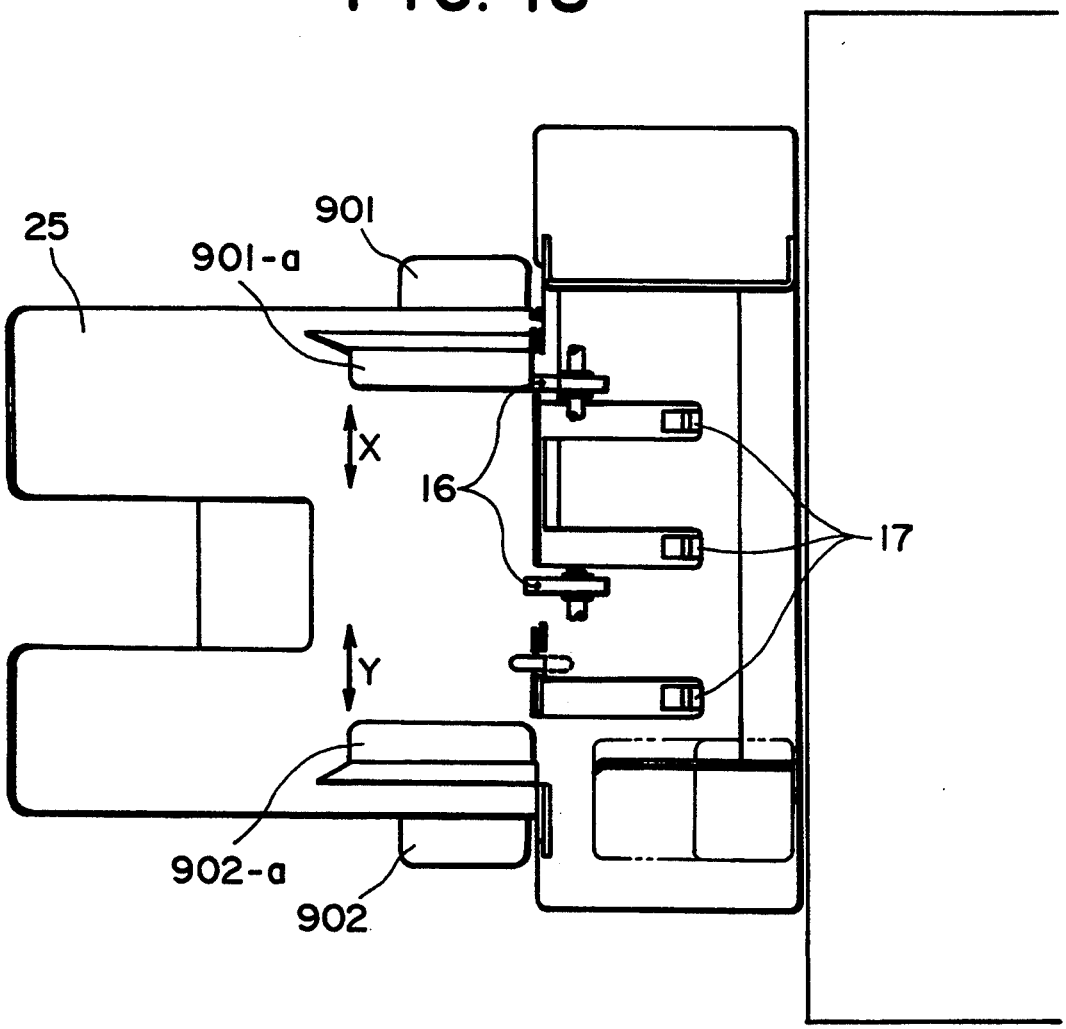
FIG. 19 is a top plan view of the apparatus.

The alignment in the lateral direction of the copy sheet can be accomplished by the lateral shifting plates 901 and 902, as shown in FIG. 19.

According to the embodiment (FIG. 1–19), the tray for the alignment and stapling is separated into a fixed stacking portion and a movable stacking portion, and the movable stacking portion is also used as an accommodating tray. By the structure, (1) The size and the weight of the entire apparatus (internal structure: side plates, stays, bottom plates and external structure: covering) can be reduced:

(2) A great number of copy sheets can be continuously accommodated with a simple structure:

(3) The throughput of the system can be increased because the movement distance between the processing station (alignment and stapling) and the accommodating station is small, and therefore, the interval between adjacent copying cycles is not required to be increased (the weighting period for the stapling and sheet pushing may be small): and (4) The sheets are shifted as they are aligned, they are not disturbed in the state of alignment not only in the stapled sheet conveyance but also in the unstapled sheets. The accommodating tray is movable in the lateral direction, and therefore, the sheets can be separated for the respective copy cycles even if the sheets are not stapled.

Second Embodiment

Figure 20:
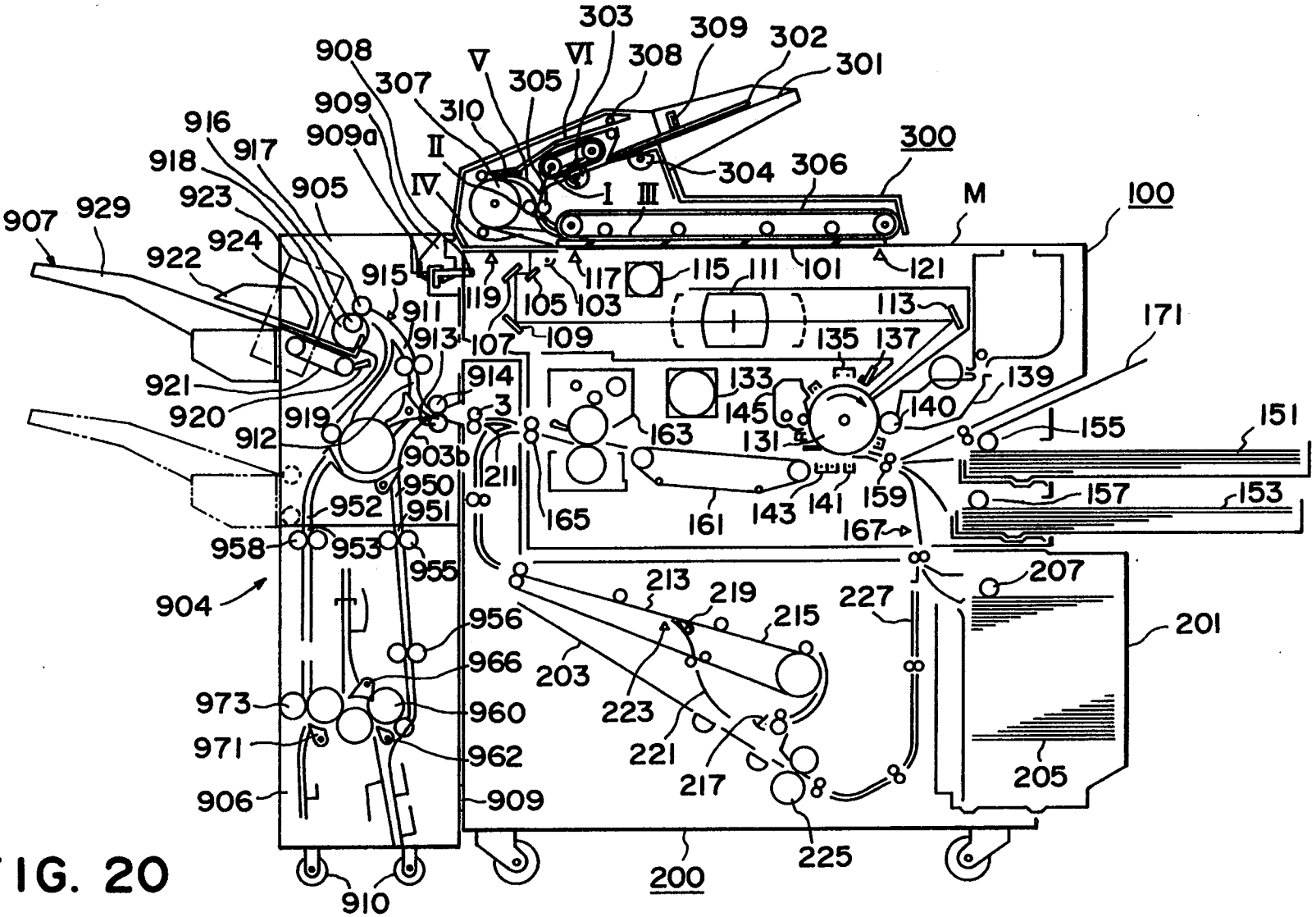
FIG. 20 is a sectional view of an image forming apparatus provided with a sheet post-processing apparatus according to a further embodiment of the preset invention.

Referring to FIG. 20, a copying apparatus according to another embodiment will be described, which comprises a main assembly 100 of the copying apparatus, a pedestal 200 having a duplex copying function including inverse of the recording material (sheet) for the duplex recording and superposing recording function wherein plural images are formed on the same recording material, a circulation type automatic document feeder 300 which will hereinafter be called "RDF", and a sheet post-processing apparatus 904 which aligns, folds, staples and/or stacks the sheets discharged from the copying apparatus.

The main assembly 100, the pedestal 200 and RDF 300 have the same structures and functions as of the FIG. 1 apparatus, and therefore, detailed descriptions thereof are omitted for simplicity, and the sheet post-processing apparatus 904 will be described in detail.

The sheet post-processing apparatus 904 includes a finisher 905 which is capable of stacking, aligning and stapling one or more copy sheets discharged from the main assembly, a folder 906 which is capable of two-folding or z-folding the copy sheets, and a stacker 907 capable of accommodating one or more sets of copy sheets having been aligned or stapled.

The coupling between the post-processing apparatus 904 and the image forming apparatus 100 is accomplished by engagement between a receiving member 908 of the main assembly 100 and a hook 909 of the post-processing apparatus 904. The bottom of the post-processing apparatus 904 is equipped with casters 910. When a sheet conveyance trouble occurs in the main assembly or in the post-processing apparatus 904, the grip 909 is slightly pulled and rotated in the counter clockwise direction about a pin 909a to disengage it from the receiving member 908, and then it is moved leftwardly to separate the main assembly 100 and the post-processing apparatus 904 to make the trouble disposal operation such as jam clearance.

Figure 21:
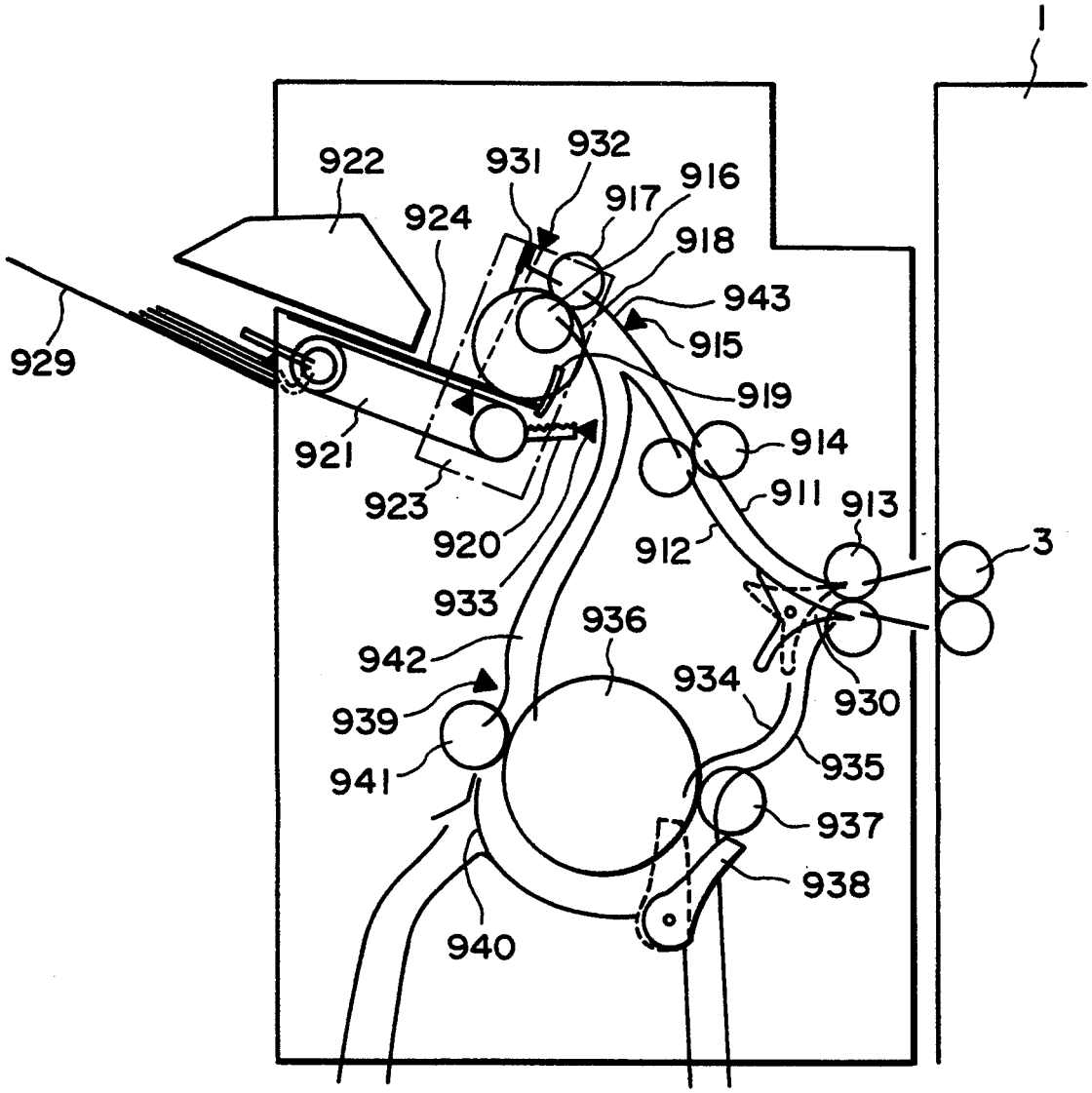
FIG. 21 is an enlarged view of a major part of a sheet passage in the sheet post-processing apparatus.

Referring to FIG. 21, the description will be made as to the details of the sheet post-processing apparatus. The copy sheet discharged by sheet discharging rollers 3 of the main assembly 100 is conveyed toward left upper direction by a pair of conveying rollers 913 and 914. At this time, a first flapper 930 takes the position indicated by solid lines, so that the copy sheet is guided by an upper guide 911 and a lower guide 912. The copy sheet is passed by a discharge sheet sensor 915, and then is discharged onto a receiving table 924 by a lower discharge roller 916 and a confining roller 917. The rotational speed of the lower discharge roller 916 is decreased to discharge the copy sheet at a lower speed, at the moment or after a predetermined time delay from he discharge sheet sensor 915 detecting the leading or trailing edge of the copy sheet. By doing so, the copy sheets on the receiving table 924 are aligned in a better form. The discharge sheet sensor 915 also functions as means for detecting a trouble when a copy sheets stagnates in the sheet passage between the upper guide 911 and the lower guide 912 by a sheet jam or the like. Discharge needles 931 disposed at the sheet outlet sweep the surface of the copy sheet each time it is discharged, thus preventing electric charging of the sheets.

An aligning belt 918 is rotatably supported around a lower discharge roller 916 of a tray and a confining roller 917. The aligning belt 918 is rotated in contact with the receiving or stacking table 924 to impart conveying force to the sheet discharged onto the table 924 to abut it to the abutment plate 919. In order to prevent the belt from disengaging, an endless rib is formed on the inside of the belt adjacent its central position, and the rib is engaged with the lower discharge roller of the tray for rotation. An abutment plate 919 provides a reference surface in the sheet conveyance direction when the copy sheets are aligned, and the staple position is, in effect, determined by the position of the abutment plate 919.

In the region 923 indicated by chain lines in FIGS. 20 and 21, a stapler unit is disposed. The stapler unit 923 is driven by a solenoid or a motor 9 staple a set of sheets discharged and aligned on the stacking table 924.

A positioning plate 922 provides an abutment reference in a direction perpendicular to the sheet conveyance (lateral direction). The copy sheet discharged onto the stacking table 924 by the discharge rollers 916 and 917, is aligned by the abutment plate 919 in the conveyance direction and by the lateral reference member 22 in the perpendicular direction, irrespective of whether the sheet is to be stapled or not. Then, the sheets are pushed for its trailing edges by a bound sheet conveying member 920, and it is stacked on a tray 929 of the stacker 907.

Figure 22:
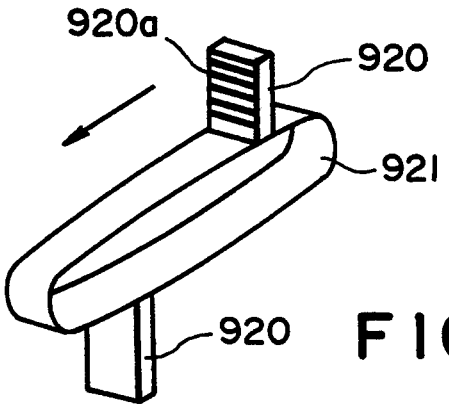
FIG. 22 illustrated detailed of a bound sheet pushing member.

As shown in FIG. 22, the bound sheet conveying member 920 is an elastic member integrally formed or bonded to the bound sheet conveying belt 921. The conveying member 920 has rigidity and elasticity sufficient to convey the bound sheets on the table 924 and to flex by abutment with a rigid structural member. The side of the elastic member for abutment with the sheets is knurled 920a in order to assure the conveyance of the sheets. In FIG. 20, only one bound sheet conveying member 920 is provided for the bound sheet conveying belt 921, but this is not limiting, and two may be provided at opposite positions, as shown in FIG. 22. By employing two of them, the time required or returning the conveying member 920 to its home position in the vicinity of the abutment plate 919, can be saved, and therefore, the operational speed is increased as an entire system.

A transparent type sensor 932 serves to detect presence and absence of the copy sheet on the stacking table 24. It confirms absence of the copy sheet on the stacking table 924 at an initial state. In addition, when the sensor 932 is not deactuated a predetermined period after actuation of the bound sheet conveying member 920, some trouble is discriminated to stop the image forming operation. A sensor 933 for detecting one turn of the conveying member 920 mounted to the conveying belt 921 is disposed adjacent the home position of the conveying member 920. This is required because after the bound sheets are pushed, the conveying member 920 has to take a ready position adjacent the abutment plate 919 in order to push the next bound sheets. When the sensor does not detect the conveying member 920 even after the drive force is imparted thereto form a sufficient period of time to return the conveying member 920 as a result of one full turn, some trouble is discriminated, and the system is stopped for safety. As described hereinbefore, the conveying member 920 has sufficient rigidity and elasticity to be flexed by abutment to a fixed member, and therefore, after it pushes the sheets out, it flexes, as shown by broken lines in FIG. 21, to return the predetermined position for conveyance of the next set of bound sheets.

Two lateral reference members 922 are provided at a front side and rear side, respectively, are moved by a stepping motor to align the copy sheets discharged on the stacking table 24 in the direction perpendicular to the conveyance direction. Also, it is possible to shift with high precision for each of the sets of the sheets.

More particularly, each time the copy sheet having the copied image is discharged, at least one of the front and rear side lateral reference members 922 is moved in the direction perpendicular to the sheet of the drawing of FIG. 21 to confine and align the sheet. Here, by changing the moving ranges of the lateral reference members, the copy sheets are aligned at different positions on the table 24 for each set of the sheets, thus providing shifted sets of sheet aligned. As an alternative, the alignment operation is performed at the same position on the table 924, and the lateral reference members 922 are shifted simultaneously with the bound sheet conveying member 920 pushes the bound sheets from the table 924 to the tray 929. In either case, the sheets stacked on the tray 929 with the shift, are accommodated on the tray with shifts for the respective bound sets in the direction perpendicular to the sheet conveyance. Therefore, when the sheets are bound by staples, the staples are not overlaid when the stapled sets are stacked, and therefore, the bulging of the stack by the stapled portions can be minimized.

Figure 23:
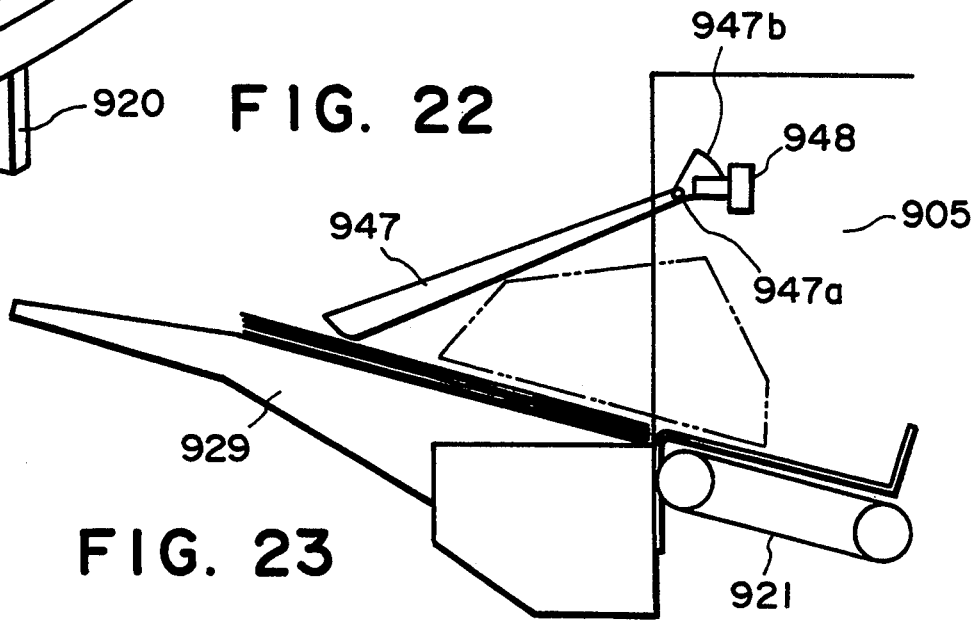
FIGS. 23 and 24 illustrate in detail a sheet level sensor.

FIG. 23 illustrates means for detecting a level of the tray 929. The copy sheet discharged from the finisher 905 is stacked on the tray 929, and a sheet sensor lever 947 is in contact with the topmost one of the stacked sheets. The sheet sensor lever 947 has a pivot **947*a* on the finisher 905 and is freely rotatable about the pivot 947*a*. An end of the lever 947 which is not contacted to the sheet is formed into a sensor flag 947*b* which is detected by a sheet level sensor 948**.

Figure 24A:
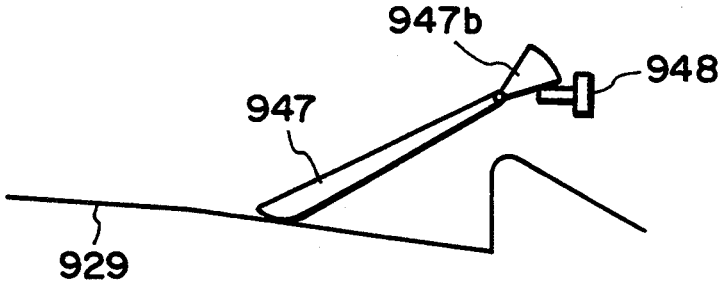
Figure 24B:
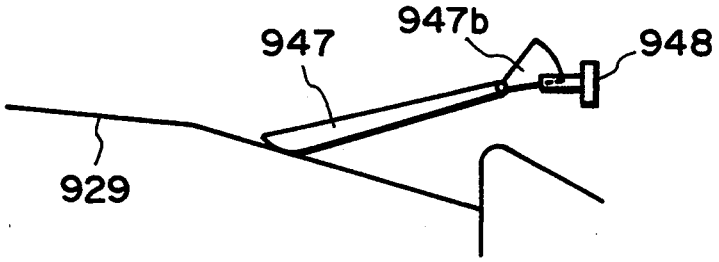
Figure 24C:
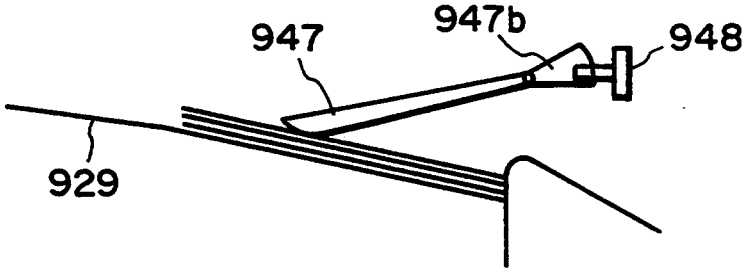

FIGS. 24A, 24B and 24C illustrate operation of the sheet sensor lever. In FIG. 24A, which shows an initial state, it is spaced from the tray surface by a certain degree. This states occurs, for example, when a previous operator completes the process, and takes the sheets away from the tray. When the next operator starts the operation, the tray moves up until the state shown in FIG. 24B is reached wherein the sheet level sensor is actuated. This indicates the stand-by state, wherein the tray can receive the copy sheet. FIG. 24C shows the state in which the copy sheets are stacked, and the sensor is on. When the sensor is actuated, the tray is lowered until the sensor is deactuated until the tray level and the discharge outlet level are in the state shown in FIG. 24B. By this control, the sheet height is maintained constant.

Figure 25:
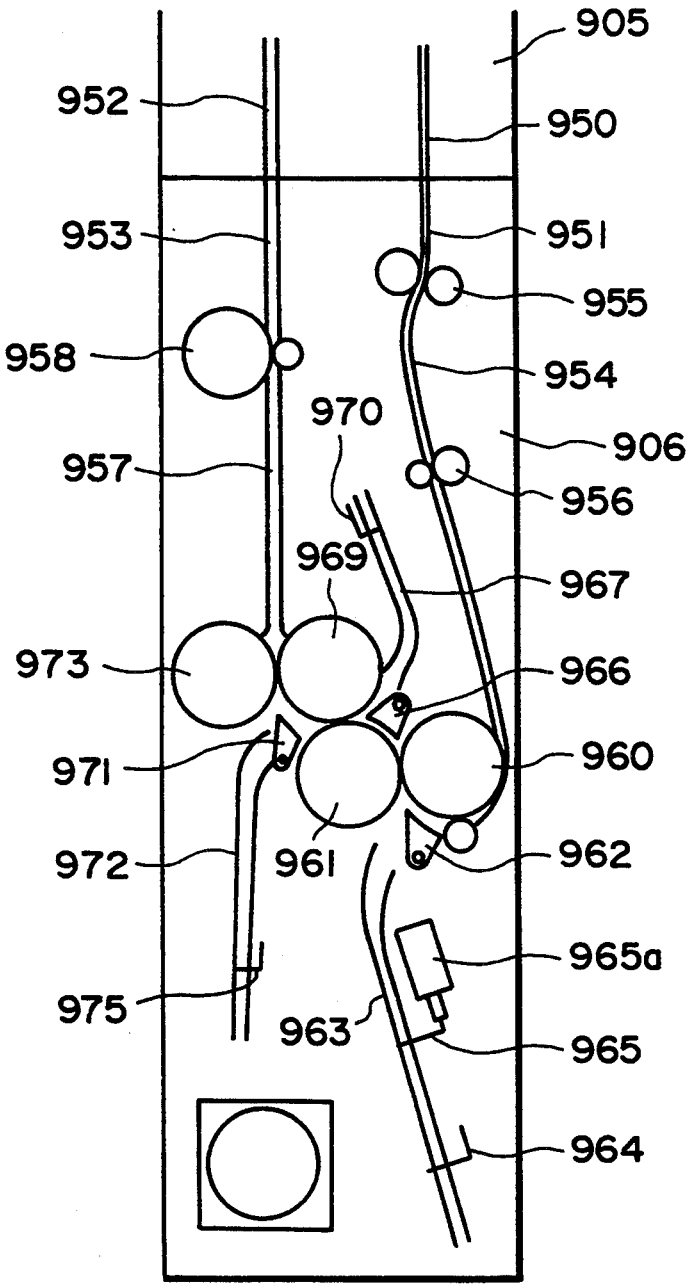
FIG. 25 is a sectional view illustrating structure of passages in a folder.

Next, the detailed of the folder 906 will be described. When the folder 906 is to be coupled, it is connected to the finisher 906, as shown in FIG. 20. FIG. 25 shows details of the folder. A discharge outlet 950 of the finisher 905 is associated with the inlet 951 of the folder 906, while the inlet 952 of the finisher 905 is associated with the discharge outlet 953 of the folder 906.

In the inlet passage 954 of the folder 906, two pairs of conveying rollers 955 and 956 are disposed, and in the discharge passage 957, a pair of conveying rollers 958 is disposed. Downstream of the folding passage 954, various members constituting a sheet folding means are mounted. The folding means includes a first folding roller 960 and a second folding roller 961 adjacent thereto. Downstream of the first folding roller 960, there is a first deflector 962, which serves to selectively direct the sheet S conveyed from the folding passage 954 to a first folding position defining passage 963 or to a first stage folding roller pair (first and second folding rollers 960 and 961). Downstream of the first folding position defining passage 963, there is disposed a fixed stopper member 963 and a movable stopper member 965 which is projected into the central portion of the passage 963 upon energization of the solenoid **965*a*. Downstream of the first stage folding roller pair (960, 961), there is a second deflector 966 which serves to selectively direct the sheet S conveyed from the first stage folding roller pair (960, 961**) to a second folding roller 961 or to a second stage folding roller pair (961,969) including a second folding roller 961 and a third folding roller 963 adjacent to the roller 961. Downstream of the second folding position defining passage 967, a fixed stopper 970 is disposed. Downstream of the second stage folding roller pair (961,969), there is a third deflector 971 which functions to selectively direct the sheet S conveyed from the second stage folding roller couple (961,969) to a third folding position defining passage 972 or to a third stage folding roller pair (969, 973) including a third folding roller 969 and a fourth folding roller 973 adjacent to the roller 969. Downstream of the third folding position defining passage 972, a fixed stopper member 975 is disposed. Furthermore, downstream of the third stage folding roller pair (969, 973), a final folding passage 957 is formed, downstream of which is communicated with the above described discharge roller pair 958.

Figure 26:
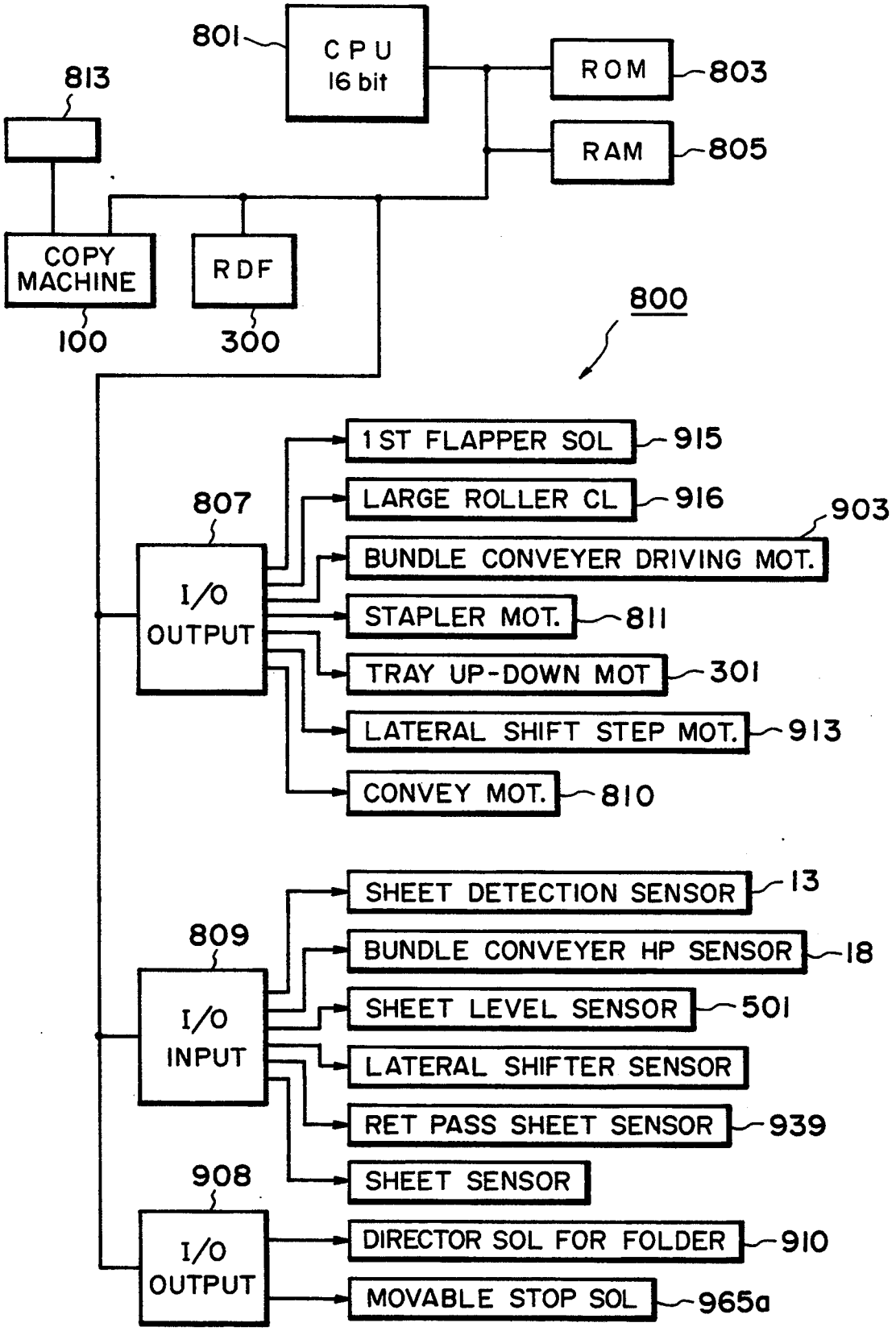
FIG. 26 is a block diagram for control of the sheet post-processing apparatus of FIG. 20.

FIG. 26 shows an example of a control system 800 or the apparatus shown in FIG. 20.

The control system includes an interface (I/O) 908 for producing a control signal to the solenoid 910 for driving the deflector of the holder and a movable stopper solenoid 965*a*. The control system also includes keys 813 for setting operational modes of the copying machine, RDF, finisher and folder and for starting and stopping them.

Figure 27:
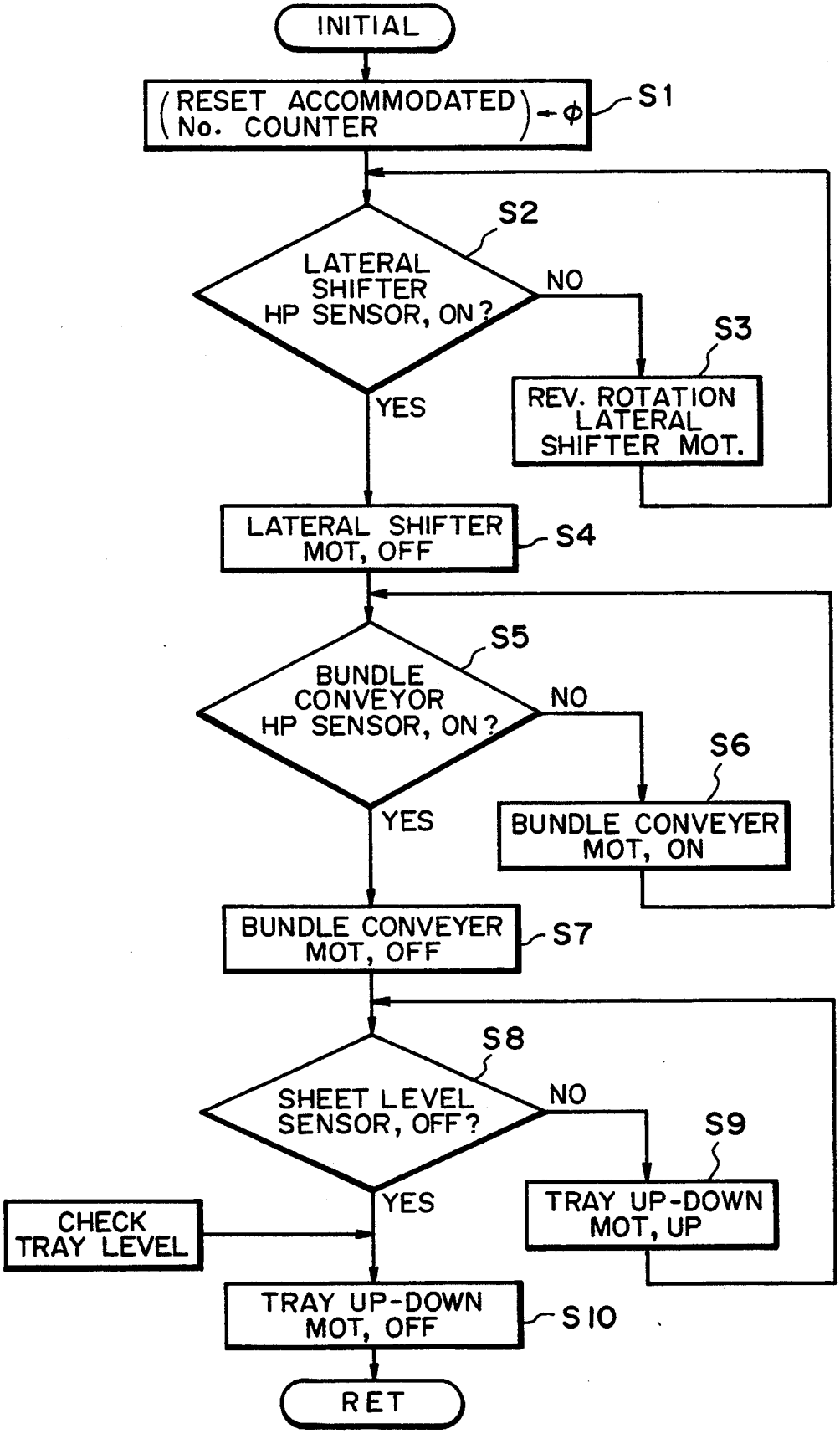
FIGS. 27–29 are flow charts for operation of the apparatus according to FIG. 20 embodiment.

Referring to FIG. 27, the description will be made as to the operation of the apparatus according to this embodiment in conjunction with the flow chart thereof. FIG. 27 is a flow chart illustrating initial operations of the post-processing apparatus performed upon actuation of the main switch of the apparatus or upon the copy start instructed.

At step S1, the accommodated number stored in a RAM 805 is reset, and at steps S2–S4, the stepping motor is reversely rotated until the lateral reference members 922 (front and rear sides) are at the home positions, and then, the stepping motor is stopped.

Then, at steps S5–S7, the motor is driven until the bound sheet conveying member reaches the home position, and the motor is stepped. At steps S8–S9, the tray level is checked, and the tray vertical movement motor is actuated for the upward movement and is driven until the sheet level sensor is actuated, and the motor is stepped there. As a result of the processing of the steps S1–S9, the sheet discharge from the copying machine is now capable of being received.

Figure 28A:
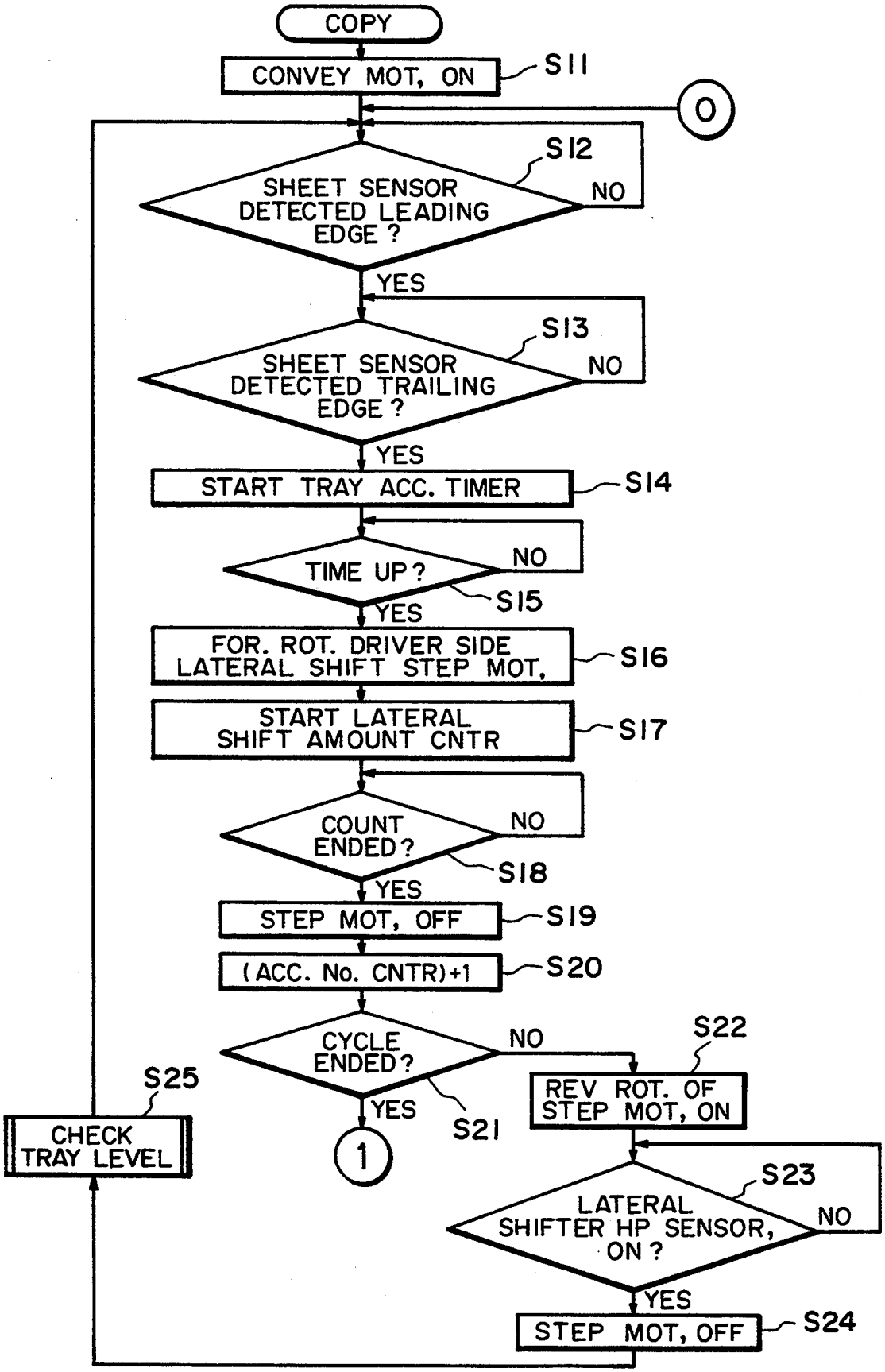
Figure 28B:
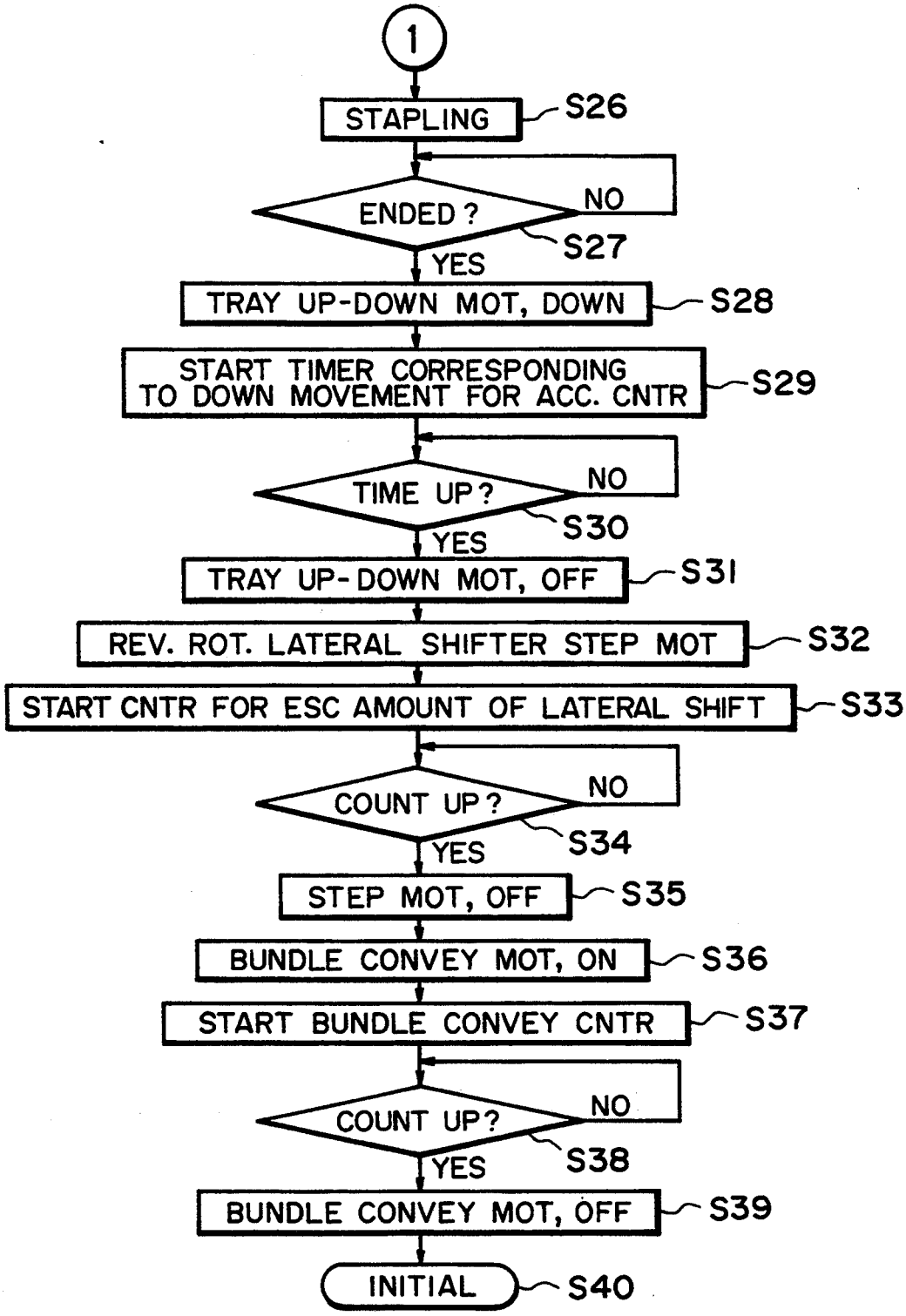

FIG. 28 is a flow chart illustrating the operation of the sheet post-processing operation after the part of the copy operation. At Step 11, the conveyance motor 810 for driving pairs of the conveying rollers 913, 914, 917, 936, 937 and 939 with actuated, and at step S12, the sheet detecting sensor 915 detects the leading edge of the sheet. At step S13, detection of the trailing edge of the sheet is waited for, and at step S14, a tray accommodation timer is started. After elapse of time required and sufficient for the sheet to be accommodated on the tray (step S15), the stepping motor 11 for the lateral reference or shifting member 922 is actuated at step S16 to effect lateral shifting by a predetermined amount (S17–S19). At step S20, the accommodated number counter is incremented by +1, and at step S21, the completion of one cycle of the copy process is checked. This can be effected by checking the signal of a circulation detecting sensor 309 by the recycling lever of the RDF. If one cycle is completed, the sequential operation advances to the stapling operation (S26). If the one cycle is not completed, the lateral shifting members 922 are returned to their home positions (S21–S24), and thereafter, the tray level is checked at step S25. If the operator takes the bound sheets from the tray, the tray is moved so at to maintain a constant level of the sheet surface.

Figure 34A:
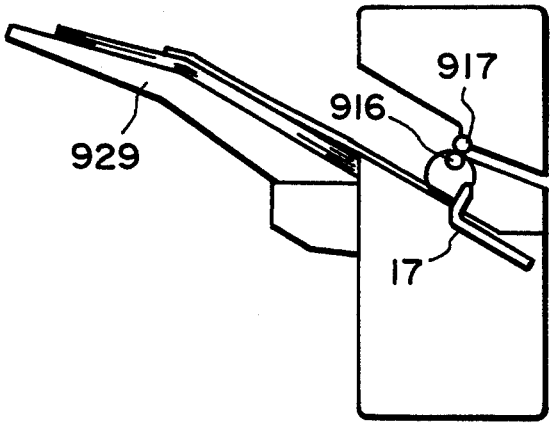
FIG. 34 illustrates operation of a stacker and a pushing member.
Figure 34B:
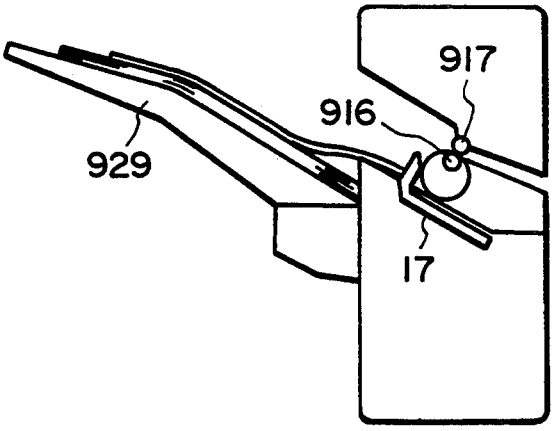

When the one cycle completion is detected at step S21, the stapler motor 811 is driven at step S26 to perform the stapling operation, and the completion of the stapling operation is waited for at step S24 (FIG. 34A). Upon the completion, the tray motor 301 is actuated for the downward movement at step S28, and the timer is started, which is set in accordance with the amount of downward movement corresponding to the accommodated number counter, at step S29. At step S30, the time-up of the timer is waited for, and the tray motor 301 is deactuated at step S31 (FIG. 34B).

The timer period is set so as to be slightly larger than the sheet number. For example, assuming the thickness of one sheet is 0.1 mm, the timer period corresponds to 2 mm downward movement when the count of the counter is 10; and it corresponds to 3 mm downward movement when the count thereof is 20.

At step S32, the lateral shift stepping motor 913 is actuated for the reverse rotation. At step S33, the lateral shift retraction counter is actuated, and the completion thereof is waited for at step S34. Then, the motor is deenergized at step S35.

Figure 34C:
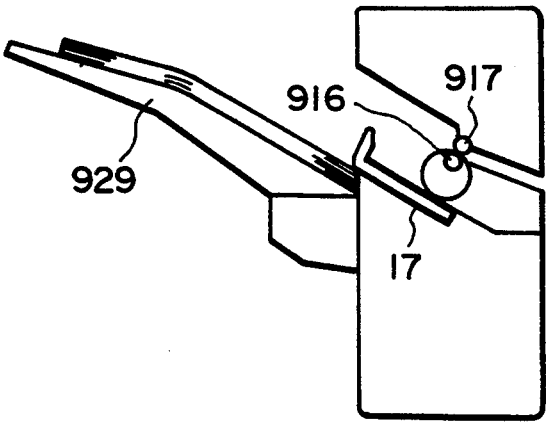
Figure 34D:
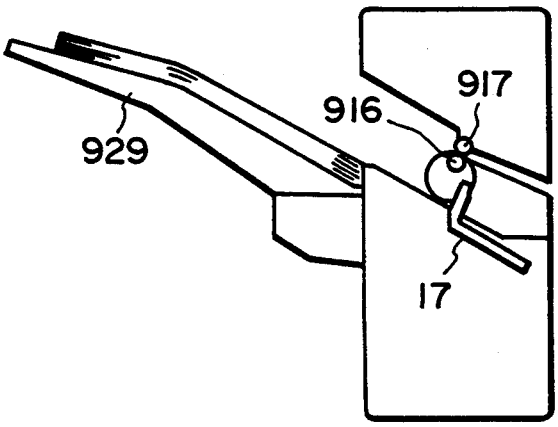

At step S36, a driving motor 903 for the bound sheet conveying member 920 effective to push the bound sheet out is actuated, and the counter for the amount of pushing is started (step S37). The completion of the counting is waited for, and the motor is stopped (steps S38 and S39). By the operations of steps S36–S39, the stapled sheets can be pushed out (FIG. 34C). At step S40, the above described initializing processing performed to return the positioning plate and the abutment plate to the initial position, and by performing the steps S28–S31, the tray which is slightly below the level corresponding to the sheet number is moved up until the level sensor is actuated to maintain the level of the surface of the sheet, and the sequence goes back to the step S12. Then, it waits for the next sheet discharge (FIG. 34D).

In this embodiment, when the sheet is pushed out to the tray 929, the sheets are laterally shifted to void overlapping of the staples, and therefore, the stapled portion do not form a bulge, whereby the discharged sheet are stacked aligned and/or stapled on the stacked sheets, as shown in FIG. 34A.

Figure 29:
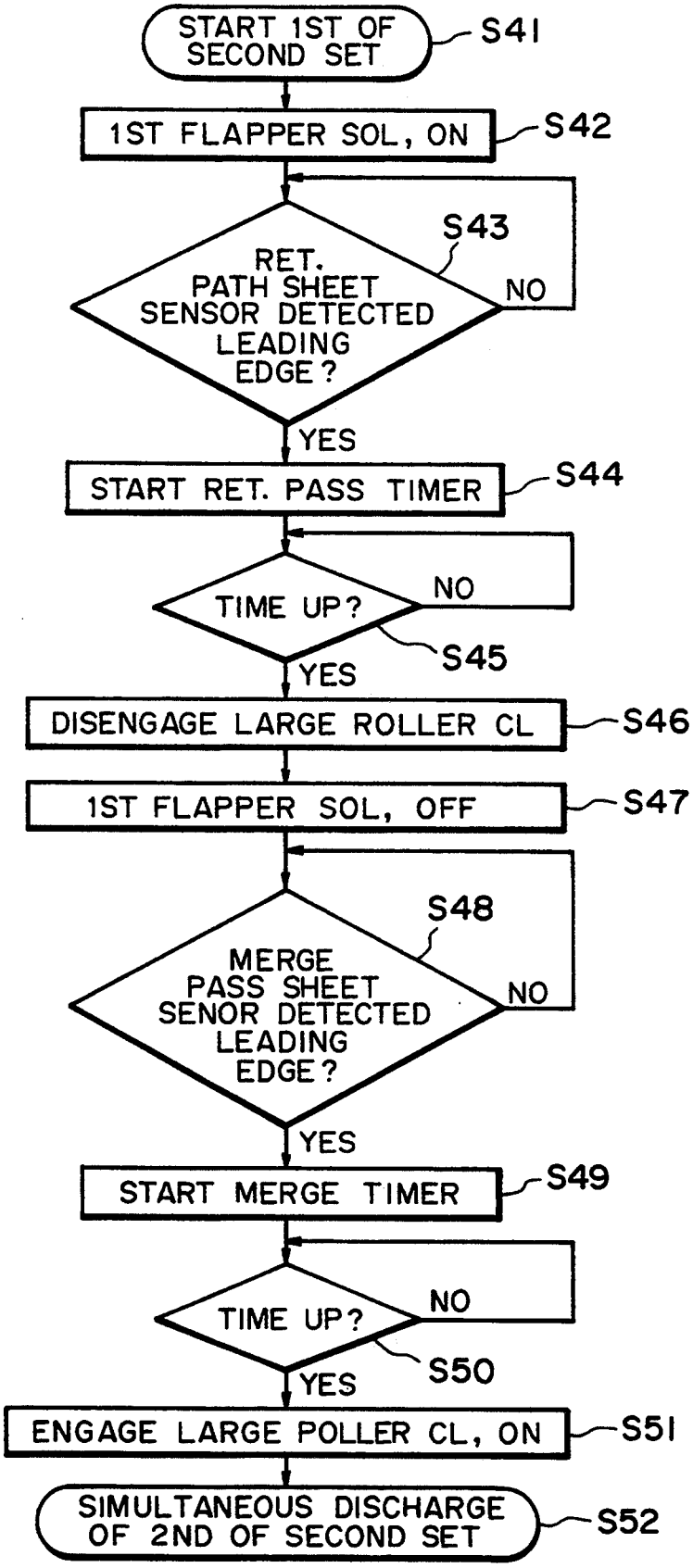

Referring to FIG. 29, the description will be made as to the operation wherein a plurality of sets of sheets are processed, and wherein first and second sheets of the second set processing are discharged substantially simultaneously. This is performed in order not to discharge a next cycle sheet onto the stacking table 924 during the operations at steps S26 and thereafter (FIG. 28) for the previous set.

When the first sheet of the second set is discharged from the main assembly at step S41 during operation after the step S26, the first flapper solenoid 915 (FIG. 26) is actuated at step S42 so that the first flapper 930 takes the broken line position. Then, the sheet is directed to the passage formed by the guiding members 934 and 935 by the first flapper 930. At this time, the second flapper 938 assumes the solid line position, and therefore the sheet is conveyed around the large roller 936 and is guided by the elastic guide 940 so that it is gripped by the large roller 936 and the roller 941. After a predetermined delay (step S44 and S45) after detection of the sheet leading edge by the sensor 939 in the return passage 941, a large roller clutch 916 (FIG. 26) for shifting drive transmission to the large roller 936 is disengaged, at step S46. The first sheet is stopped with its leading edge immediately before the sheet detecting sensor 915 of the merging passage 943. Subsequently, the first flapper solenoid 915 is deenergized at step S47 in preparation for the second sheet so as to reset the first flapper 930 to the solid line position. The second sheet is conveyed between the guides 911 and 912 and is directed to the merging passage 943. At step S48, the leading edge of the second sheet is detected by the sheet detecting sensor 915, elapse of a predetermined time period is waited for at steps 49 and 50.. After the leading edge of the second sheet is gripped by the discharging roller pairs 916 and 917, the large roller clutch 916 is actuated at step 51, and the large roller 936 is rotated. The first sheet is conveyed by the rotation of the large roller 936, and is discharged while overlapping with the second sheet through the merging passage 943.

Strictly, however, they are slightly deviated since the second sheet is slightly leading. This is done in order that when the sheets are aligned by the aligning belt 918 abutting the sheets to the abutment plate 919 after the sheet discharge, the first sheet which is the lower sheet is first moved, and then the second sheet which is the upper sheet is moved. If the first and second sheets are completely overlapped when they are discharged, the upper second sheet is moved first without action to the first sheet. The third and subsequent sheets are conveyed through the passage defined by the guiding plates 911 and 912 until the number of sheets equal to the number of originals are stacked on the stacking table 924.

The reason why the first sheet of the second set, unlike the first set thereof, is conveyed through the returning passage 42 around the large roller 936, not through the usual passage, is that the first sheet of the second set is delayed in the returning passage 42 while the first set of the sheets are stapled or are aligned and pushed out to the stacker tray 29, after all the sheets in the first set are discharged on the stacking table 924. By doing so, no waiting period is required between the first set image forming operation and the second set image forming operation, and therefore, the throughput of the entire system is improved.

When all the copies are completed for the second set, they are stacked on the stacker tray 929 with distinction from the first set after operation of the stapler means, if desired.

Figure 30:
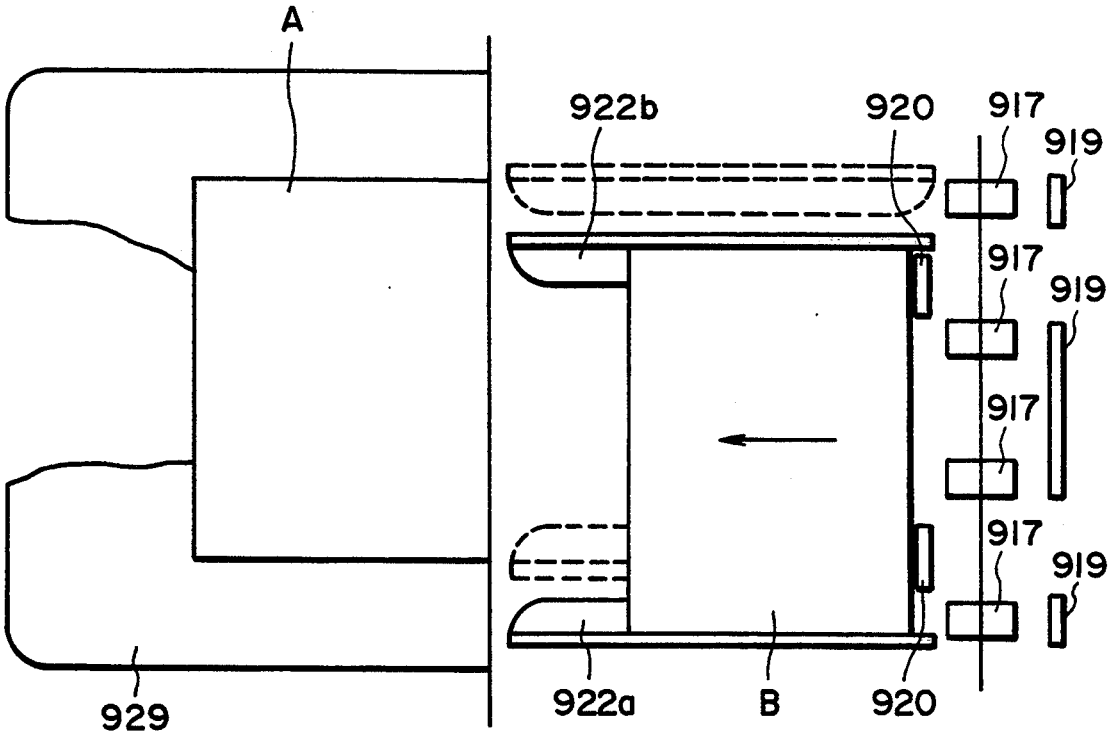
FIGS. 30 and 31 illustrate operation of a lateral shifting member.

FIG. 30 is a top plan view of the stacker tray 929 and elements therearound. On the stacker tray 929, the first set of copy sheets A is stacked, and the second set is pushed leftwardly by the pushing member 920 while at the same time it is shifted rearwardly or frontwardly (frontwardly in FIG. 30) by the lateral shifting members 922a and 922b. The second set B thus pushed out is deviated by the amount of the shift of the lateral shifting member, thus it is distinguished from the first set.

In the processing of the third set, similarly to the second set, the first sheet is once stopped in the returning passage 942, and thereafter, the first and second sheets are substantially simultaneously discharged. When it is stacked on the stacker tray 929, it is offset from the second set. The offsetting fashion may be different from the offset between the first set and the second set, and alternatively, the third set may takes the same position as the first set so that only two positions of offset for the odd number sets and the even number sets, respectively.

Figure 31:
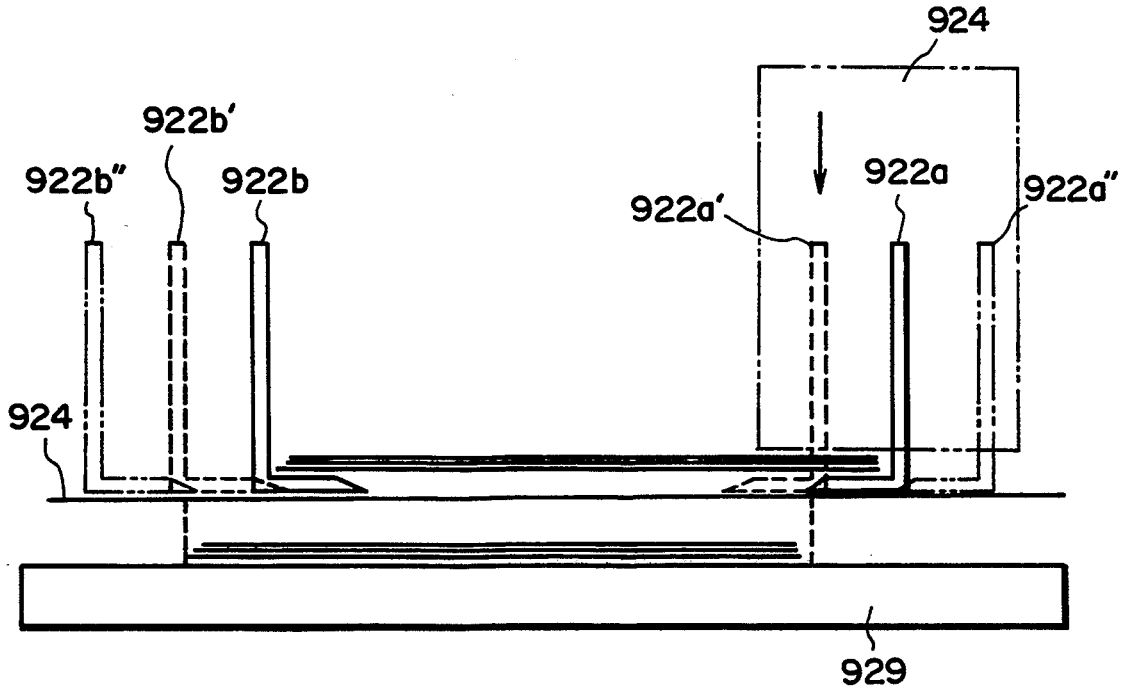

Referring to FIG. 31, the operation of the lateral shifting members 922 will be descried. FIG. 31 is a view seen from the left side, and the lateral shifting members 922*a* and 922*b* are disposed at the front side and the rear side, respectively. The stapler is designated by a reference numeral 924 and is effective to staple the sheets at the position of the arrow.

First, the description will be made as to the case where the stapling operation is instructed on the keyboard 813 (stapling mode). When the copy sheet is discharged onto the stacking table 924, the lateral shifting member 922*a* is fixed at the position shown, but the rear lateral shifting member 922*b* is placed away from the front lateral shifting member 922*a* by an amount of copy sheet width $+\alpha$ toward the rear side. Each time the copy sheet is discharged, the rear lateral shifting member 922*b* moves toward the front lateral shifting member 922*a* by an amount $\alpha$ to align sheet. The amount $\alpha$ is determined on performance of the machine, and the system processing speed is increased with decrease of the amount $\alpha$.

The copy sheets aligned relative to the front side member 922*a* are stapled and is pushed out without lateral shift.

The second set of sheets are similarly stapled, and thereafter, the set is shifted by both of the lateral shifting members 922*a* and 922*b* to the position indicated by the references 922*a'* and 922*b'*. Then, the first set and the second set are offset by the amount of the difference between (922*a*, 922*b*) and (922*a'* 922*b'*) and are stacked on the stacker tray 929, so that the sets are distinguished.

The amount of offset may be changed by, for example, alternately changing the count set at the steps S33 and S34. When the sheets are stapled, the front side lateral shifting member 922*a* is required to be positioned indicated by the reference 922*a* when the copy sheet is discharged, provided that the stapler 924 is not movable in the front-rear direction, that is, right-left direction in FIG. 31. For this reason, the processing speed is increased with decrease of the distance between the position indicated by 922*a'* and the position indicated by 922*a*.

Now, the description will be made as to the case where the stapling means is not used (non-stapling mode). In this case, the home position of the lateral shifting member is also the front side position 922*a*. After the sheets are aligned by the lateral shifting members 922*a* and 922*b*, the sheets are not pushed out as they are, but are pushed out with shift toward front or rear. For example, they are pushed out while being shifted toward rear, and they are stacked on the tray at the position indicated by reference numerals 922*a'* and 922*b'*. In the second sets, they are shifted frontwardly and the second set is stacked at the position indicated by references 922*a''* and 922*b''*. The reason why it is not pushed out at the home position is that if the pushing-out at the home position and the pushing-out with the shift are combined, the time required for returning to the home position is different between the shift case and non-shift case, with the result of waste of time.

An instance is taken wherein the amount of shift for distinguishing the first set and the second set is $\beta$. The first case is a combination of the discharge at the home position and a discharge with a shift $\beta$, and the second case is a combination of a discharge with a shift $\beta/2$ leftwardly from the home position and a discharge with a shift $\beta/2$ rightwardly. The time required for returning the home position is constant in the second case, and therefore, the waste of time is eliminated with increase of the entire processing speed.

The description will now be made as to the operation when the folder 906 is moved. When the folding mode is selected on the keyboard 813, the flappers 930 and 938 shown in FIG. 21 are displaced to the respective positioned shown by broken lines. The copy sheets conveyed from the discharging roller 3 of the main assembly 100 is passed by the conveying roller 913, and then is introduced into the folder via the lower conveyance passage 935. The sheet S is conveyed through the folding passage 954 shown in FIG. 25, and is directed to the first deflector 962 by the rotation of the first folding roller 960.

Figures 32A, 32B:
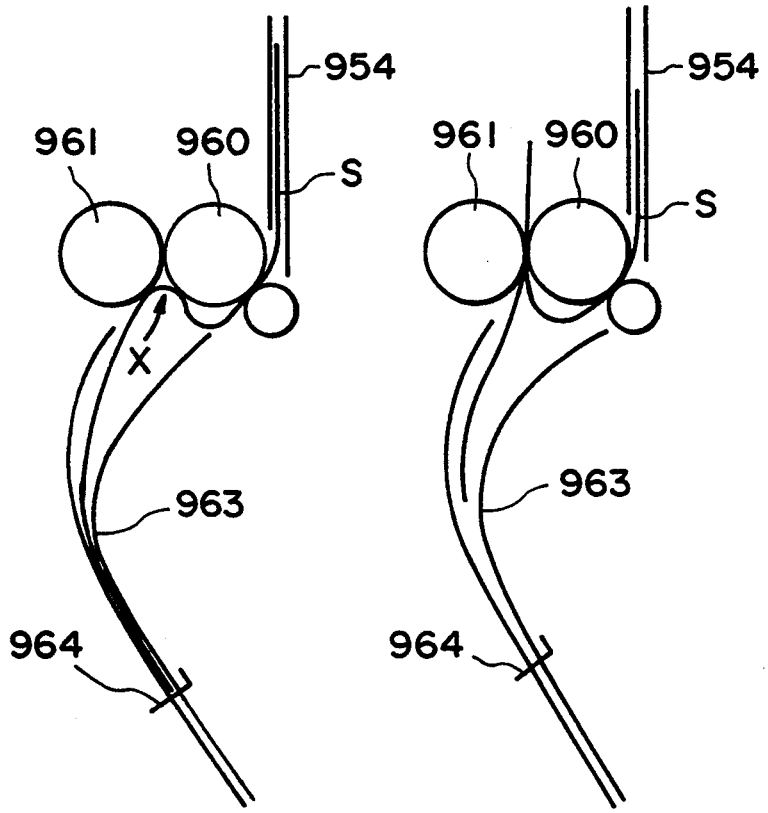
FIGS. 32 and 33 illustrate operation of the folder.

When a two-folding mode is selected, the first deflector 962 is switched to a position for conveyance to the first folding position defining passage 963 by the solenoid 910 responsive to a signal from the control circuit 801, so that the sheet S is conveyed to the first folding position defining passage 963. Thus, the leading edge of the sheet S is abutted to the fixed stopper member 964. At this time, the solenoid 965*a* for actuating the movable stopper member 965 is not energized, and therefore, the movable stopper member 965 is not projected into the folding position defining passage 963. By the abutment of the sheet S to the fixed stopper member 964, a loop X of the sheet S is formed in its central portion, as shown in FIG. 32A. The loop X of the sheet S is introduced into the nip formed between the first stage folding rollers 960 and 961, as shown in FIG. 32B, by which a fold is formed at the center of the sheet S. The folded sheet S is guided by the second deflector 966 switched to the second stage folding roller pair (961 and 969) side and the third deflector 971 switched to the third stage folding roller pair (969 and 973) side. The sheet is conveyed through the second stage folding roller pair (961 and 969), the third stage folding roller pair (969 and 973) and the outlet passage 957. It is conveyed to the sheet outlet 953 by rotation of the conveying roller pair 958.

Figure 33A:
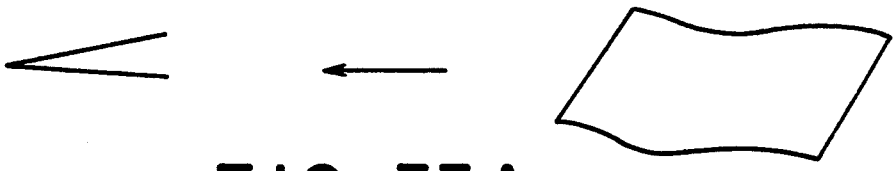
Figure 33B:
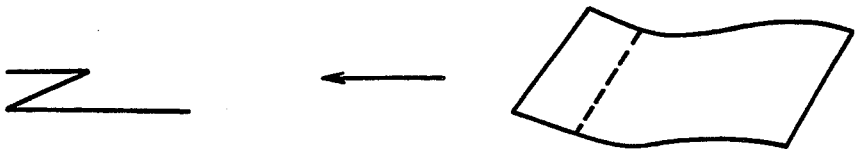

Referring to FIG. 33B, when the Z-folding mode is selected, the first deflector 962 is switched to the first folding position defining passage 963 side, and the solenoid 965*a* is energized so that the movable stopper 965 is projected into the folding position defining passage 963. Then, the sheet S is guided by the first deflector 962 and is conveyed into the first folding position defining passage 963. The leading edge of the sheet S is abutted to the movable stopper member 964. Then, a loop is formed at a position away from the leading edge thereof by approximately one fourth length, the loop of the sheet S is introduced into the nip formed between first folding rollers 960 and 961, by which a first fall is formed at a position one fourth away from the leading edge of the sheet S. The sheet S thus folded is guided by the second deflector 966 switched to the second folding position defining passage 967 side and is conveyed into the second folding position defining passage 967, until the leading edge of the sheet S is abutted to the fixed stopper member 970. Then, a loop is formed in the portion adjacent to the folded sheet S, and the loop of the sheet S is introduced into a nip formed between the second stage folding rollers 961 and 969, by which the second fold is formed there, so that a z-folded sheet is produced. The sheet S is guided by the third deflector 971 now switched to the third stage folding roller as 969 and 973 side and is conveyed through the third stage folding roller pair (969 and 973) and a folded sheet outlet passage 957. Finally, it is conveyed to the sheet discharge outlet by rotation of the conveying roller pair 958.

Figure 33C:
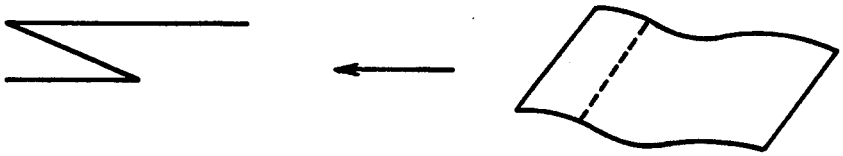

Referring to FIG. 33C, when an inverted z-folding mode is selected, the first deflector 962 is switched to the first stage folding roller pair (960 and 961) side, and the second deflector 966 is switched to the second folding position defining passage 967 side. The sheet S is conveyed to the second folding position defining passage 967 by the deflectors 962 and 966 and the first stage folding roller pair (960 and 961), until the leading edge of the sheet S is abutted to the fixed stopper member 970. Then, a loop is formed at a position about one fourth away from the leading edge of the sheet S, and the loop of the sheet S is introduced into the second stage folding rollers 961 and 969, by which first fold is formed reversely at the position of one fourth. The sheet S now having the first fold is guided by the third deflector 971 switched to the third folding position defining passage 972 and is conveyed into the third folding position defining passage 972, until the leading edge of the sheet is abutted to the fixed stopper member 975. Then, a loop is formed at end portion of the first-folded sheet S, and the loop of the sheet S is introduced into the third stage folding rollers 969 and 973, so that a second fold is formed adjacent to the end of the first folded sheet S and at the inverse side relative to the above described regular z-folding mode, a second fold is formed. Thus, the inverse z-fold sheet is produced. Further, the sheet S is conveyed through the fold discharge outlet 957, and it is discharged through the sheet discharge outlet 953 by rotation of the conveying roller 958.

Modifications

In the embodiment, the reference position of the lateral shifting member have been the position indicated by the reference 922*a* in FIG. 31 irrespective of whether the stapling mode or the non-stapling mode is selected. However, the reference position for the lateral shifting in the non-stapling mode can be set irrespective to the position of the staple of the stapler, while the copy sheets have to be shifted to the staple position of the stapler in the stapling mode.

Therefore, the time required for the lateral shifting can be saved by an additional lateral reference wall adjacent to the reference for the sheet running, for the non-stapling mode.

This concept can be developed further by incorporating the offset to further increase the processing speed, although this is also limited to the non-stapling mode. In the description of the embodiment in FIG. 31, the sheets are once aligned to the position 922*a*, and then are offset to the position 922*a*' or 922*a*''. It is considered, however, that when the sheets are to be offset leftwardly (rearwardly), the wall 922*b*'' is taken as a reference wall, whereas when they are to be shifted rightwardly (frontwardly), the wall 922*a*'' is taken as the reference wall, by which the sheets are aligned to the reference wall while at the same time being laterally shifted to the offset position.

In the foregoing, the lateral shifting members 922 are used to align the bound sheets and laterally shift them at the time when they are pushed out onto the tray 929 of the stacker 907. However, the present invention is not limited to this. It is possible that the alignment and pushing-out of the sheets are performed at a predetermine fixed position, and the stacker 907 is moved horizontally in a direction perpendicular to the sheet pushing direction each time a set of the sheets is discharged. In this case, the horizontal movement is required to be effected before the next sheet is discharged. By reciprocating the stacker 907 in the horizontal direction, the sets of sheets are stacked with offset, and the stapled portions are prevented from being overlapped.

The present invention is applicable when the stapling means and the stacking means are not so closed. For example, even in the case of the sheet post-processing apparatus as disclosed in Japanese Laid-Open Patent Application No. 78069/1984 (DB 2126997B) wherein there is a conveyance passage between the stapling means and the stacking means, the sheets are stapled, and then selectively laterally shifted, and thereafter, the sheets are conveyed to the stacking means through the conveyance passage. It is a possible alternative that the stacking means is shifted horizontally each time a set of sheets are discharged. Further alternatively, the conveyance passage may be provided with means for laterally shifting the sets of sheets.

Third Embodiment

A further embodiment will be described.

Figure 35:
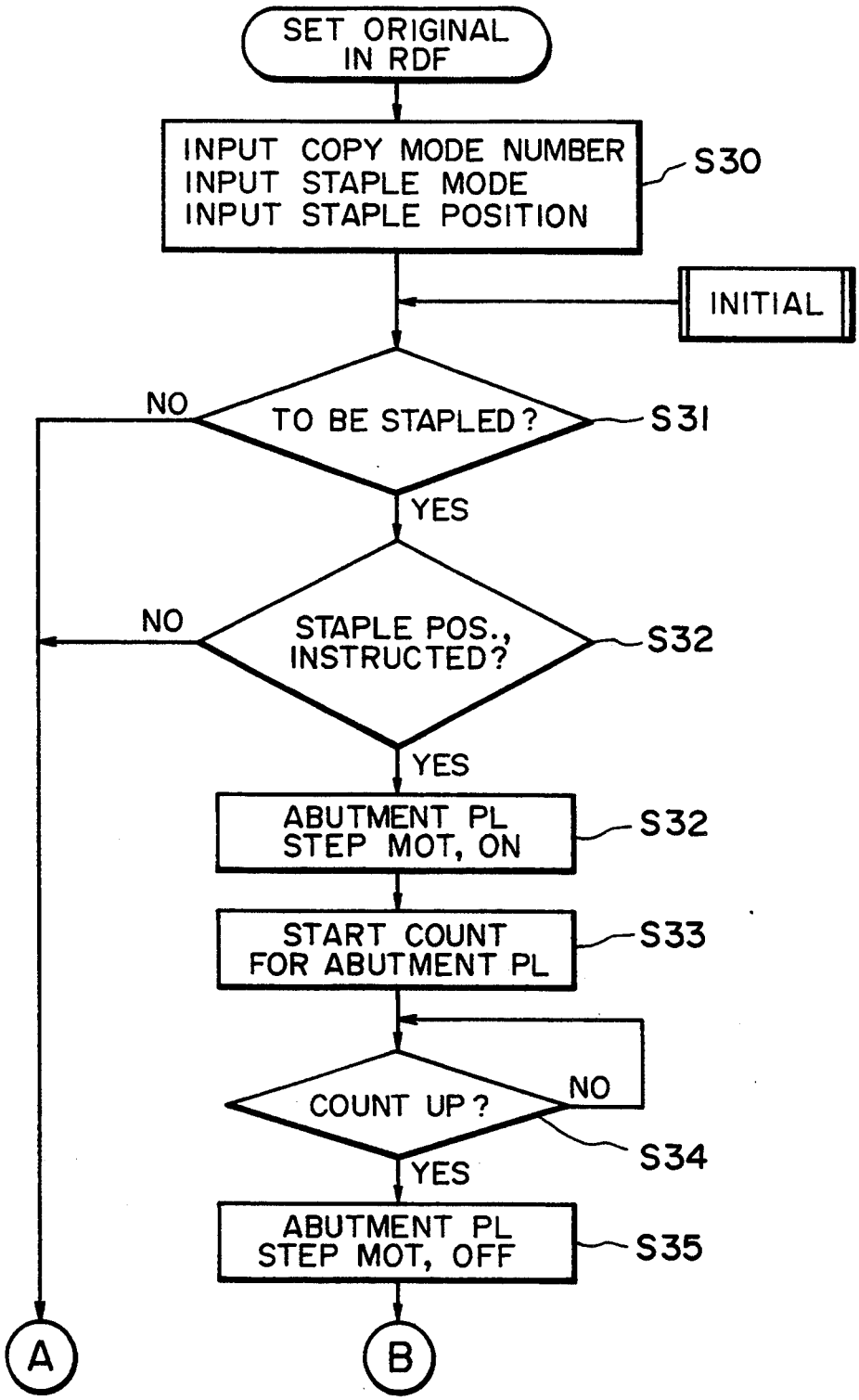
FIGS. 35–37 are flow charts illustrating operation of an apparatus according to a further embodiment of the present invention.

Referring to FIG. 35, a flow chart for the control for changing the stapling position relative to the sheets is shown. After setting the originals on the RDF 300, the operator sets at step S30 a copy process mode, a number of copies to be taken, a stapling mode and stapling position, on the keyboard 813. The stapling position may be set in coordinate position (for example a distance from a top edge of the sheet) or it may be set by selecting one of predetermined plural stapling positions.

Figure 38A:
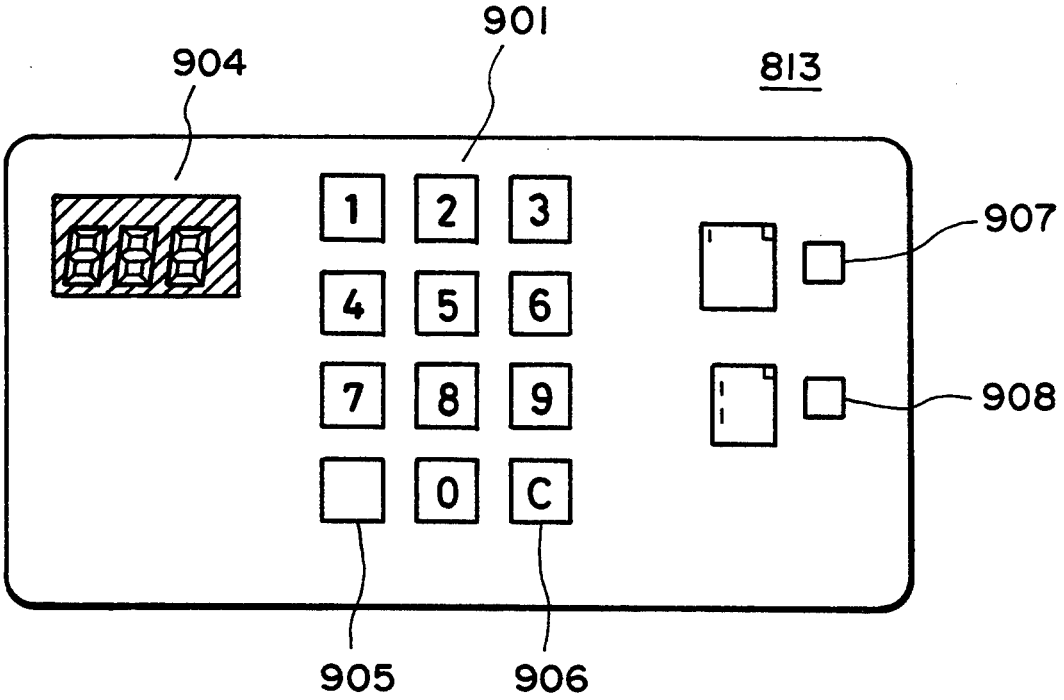
FIG. 38 is a stapling position selector key.
Figure 38B:
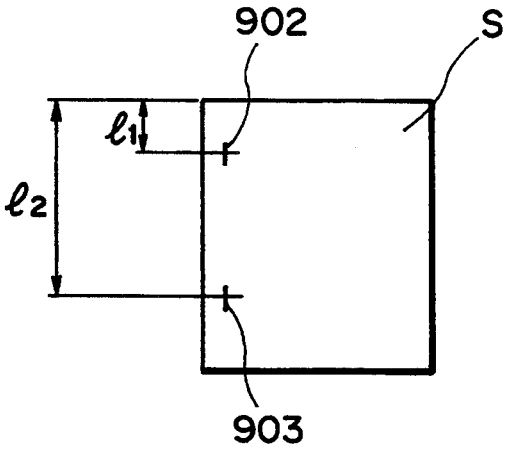

FIG. 38A shows a part of the keyboard 813 having a stapling position inputting keys. Ten keys 901 are effective to set the stapling position numerically. In FIG. 38B, when a distance from the top edge of the sets of the sheets S to the center of the first staple 902 is $l_1$ (mm), and the distance from the same top end to the center of the second staple 903 is $l_2$, the numericals corresponding to the distances $l_1$ and $l_2$ are set in the ten keys 901. The input numericals are displayed on the display 904. A key 905 is effective to switch the display and input between $l_1$ and $l_2$. The input can be cleared by a clear key 906. Keys 907 and 908 are effective to staple at the positions illustrated.

Figure 36:
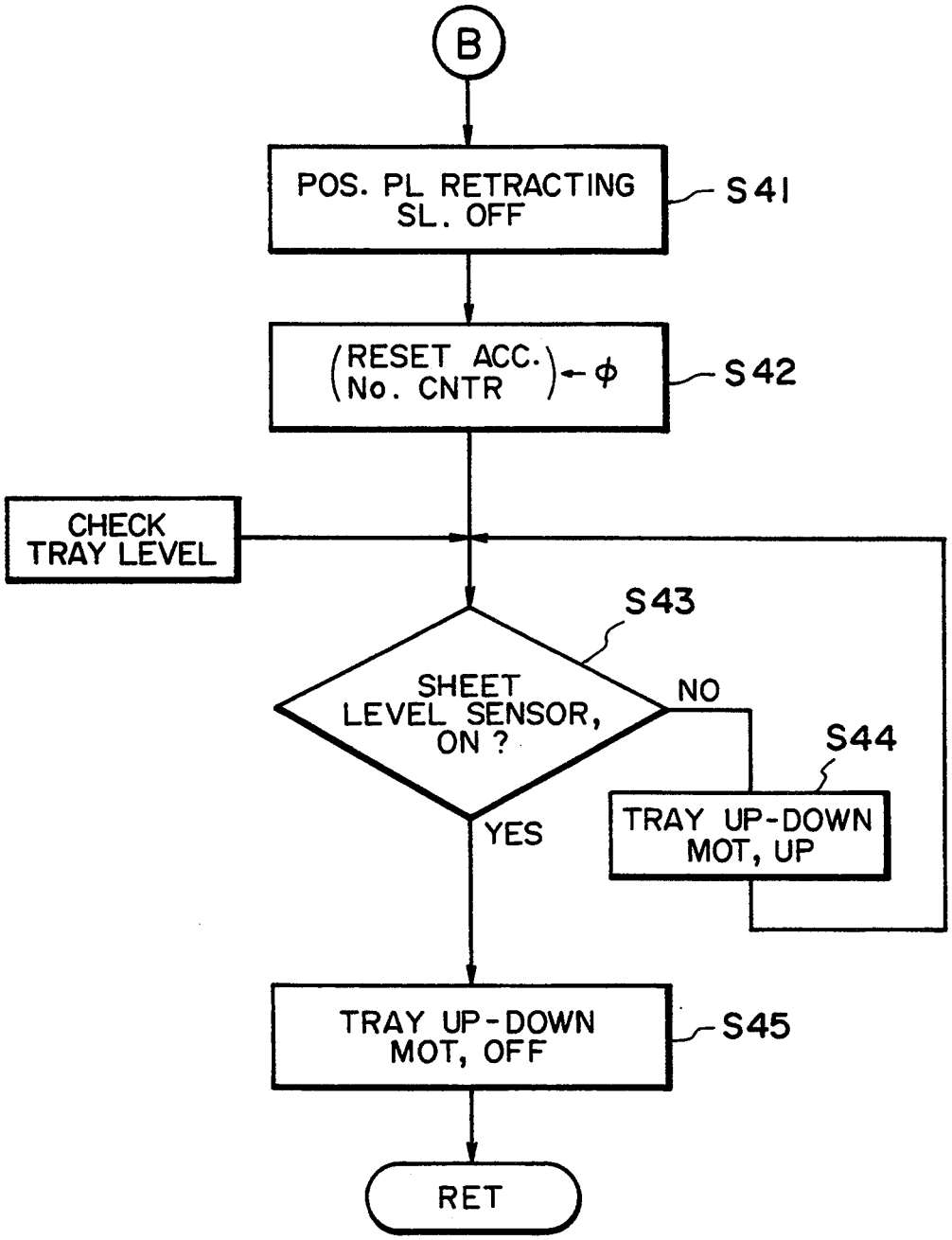

At step S31, the discrimination is made in accordance with the input whether the stapling operation is to be performed or not. When the staple is not to be performed, the sequential operation advances into the routine at step S1 in FIG. 13 (waiting for the copy start). At step S32, the discrimination is made as to whether the stapling position is instructed or not. If not; the sequence goes to the step S1 in FIG. 13. If so, the stepping motor 203 for moving the abutment plate 17 (FIG. 1) is driven at step S32. Next, at step S33 a counter is started. When the abutment plate is changed in its position, the position, relative to the stapler 24 of the sheets positioned and aligned to the abutment plate changes, and the staple position also changes. When the counting required for shifting the abutment plate so as to staple at the input position is completed (step S34), the stepping motor 203 is stopped at step S35. Then, the operation is performed in accordance with the flow chart shown in FIG. 36. In FIG. 36, at step S41, the positioning plate retracting solenoid 403 is deenergized so that the stapling position is assumed, and at step S42, the accommodated number counter is restored to zero. Next, at step S43–S45, the level of the tray is checked, and the tray motor is actuated for upward movement and is driven until the sheet level sensor is actuated. Then, the motor is stopped.

Subsequently, the operation is performed in accordance with the flow chart shown in FIG. 14, and at step S24, the operation is transferred to step S30 of FIG. 35, and the operation is repeated.

In the third embodiment, the abutment member 17 is movable so as to allow the sheets to be stapled at a desired position or positions. When the punched sheets are to be stapled, they are desired to be stapled at two positions in order to assure the stapling. Therefore, it is considered that to achieve this, after the stapling is effected, the abutment member 17 is moved to provide an offset stapling position, and the stapling is performed again.

Figure 37:
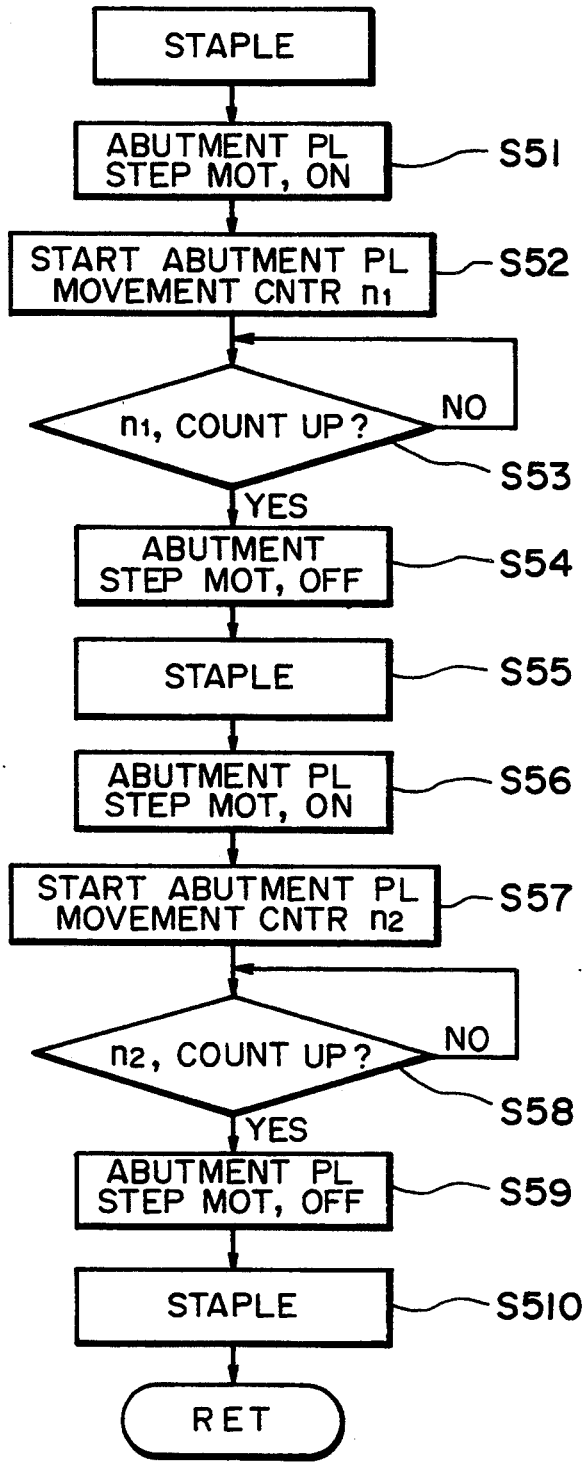

More particularly, referring back to FIG. 14, at step S18, the flow chart shown in FIG. 37 is performed. In FIG. 37, at steps S51–S54, the sheets are moved so that they are stapled at a position or positions preset. To do this, the stepping motor 203 is rotated through a count $n_1$ corresponding to the stapling position, and the sheet is pushed by the abutment plate. And then, at step S55, the stapling action is effected. Further, at step S56–S510, the same operation is performed, so that a two-position stapling is completed. The number of stapling positions is not limited to two it may be three or more.

In the foregoing embodiment, the abutment plate for aligning the sheets are moved to shift the sheets to staple them at a selected position or positions, but it is possible to use conveying means such as the conveying belt or the conveying roller. In addition, the sheet may be shifted by conveying means for discharging the sheet from the stapling table, then, the same function can be provided without increasing the size of the apparatus and without making the apparatus complicated.

While the invention has been described with reference to the structures disclosed herein, it is not confined to the details set forth and this application is intended to cover such modifications or changes as may come within the purposes of the improvements or the scope of the following claims.

What is claimed is:

1. A sheet-processing apparatus, comprising:

means for discharging sheets;

stacking means for stacking the sheets discharged by said discharging means, said stacking means including a first tray adjacent said discharging means for supporting trailing portions of the sheets discharged by said discharging means and a second tray for supporting leading portions of the sheets having the trailing portions supported by the first tray, said second tray movable substantially in the vertical direction and disposed downstream of said first tray with respect to a sheet discharge direction, wherein said stacking means is inclined so that the sheets stacked bridging between said first tray and said second tray slide by their own weight;

binding means for binding the sheets stacked on the first tray of said stacking means; and moving means for moving the sheets bound by said binding means toward said second tray.

2. An apparatus according to claim 1, wherein said first and second trays are supported in a manner to provide that their sheet stacking surfaces are substantially at the same level at least during one point during the operation of said sheet processing apparatus.

3. An apparatus according to claim 2, further comprising vertical movement control means for lowering the second tray to bring a top surface of the sheets on the second tray into the same level as a sheet stacking surface of the first tray.

4. An apparatus according to claim 3, wherein the first and second trays are inclined upwardly toward downstream with respect to a direction of sheet discharge, and there is provided a regulating means for regulating positions of the edge of the sheets stacked on said stacking means in a direction of the sheet discharge, and wherein said regulating means is disposed adjacent upstream ends of said trays.

5. An apparatus according to claim 4, wherein said regulating means also functions as said moving means, said regulating means moving the sheets bound by said binding means from said stacking means.

6. An apparatus according to claim 1, wherein said first tray and said second tray are inclined upwardly toward downstream with respect to a direction of sheet discharge, wherein there is provided a regulating means for regulating positions of edges of the sheets stacked on said stacking means in a direction of sheet discharge and wherein said regulating means is disposed adjacent an upstream end of said stacking means.

7. An apparatus according to claim 6, wherein said regulating means also functions as moving means, said regulating means moving the sheets bound by said binding means from said stacking means.

8. An apparatus according to claim 1, further comprising a regulating means for regulating an edge position of the sheets and an aligning a rotatable member for abutting the discharged sheets to the regulating means.

9. An apparatus according to claim 8, wherein said aligning rotatable member is disposed at a first tray side.

10. An apparatus according to claim 9, further comprising a control means for moving said regulating means for selectively positioning said regulating means at a position where aligned edges of the sheet are facing said binding means or a position where it regulates the sheets on said second tray.

11. An apparatus according to claim 1, wherein said moving means includes a rotatable belt conveying means fixed to the rotatable belt for pushing the bound sheets from said first tray on said stacking means toward said second tray.

12. A sheet-processing apparatus, according to claim 1, further comprising:

regulating means for regulating edges of the sheet stacked on said stacking means, wherein a binding position of said binding means is changed by changing the position of said regulating means; and control means for controlling said regulating means to change its regulating position to provide different relative position of sheet edges to said binding means.

13. An apparatus according to claim 12, wherein said regulating means regulates the sheets in a direction of sheet discharge.

14. An apparatus according to claim 13, further comprising a keyboard for setting a binding position.

15. An apparatus according to claim 14, further comprising a lateral guide for regulating lateral edges of the sheets.

16. An image forming apparatus, comprising:

means for forming images on sheets;

a sheet conveyance passage for introducing the sheets into said image forming means and for conveying the sheets on which images are formed from said image forming means;

discharging means communicating with said sheet conveyance passage for discharging the sheets;

stacking means for stacking the sheets discharged by said discharging means, said stacking means including a first tray adjacent said discharging means for supporting trailing portions of the sheets discharged by said discharging means, and a second tray for supporting leading portions of the sheets having the trailing portions supported by the first tray, said second tray being movable substantially in the vertical direction and disposed downstream of said first tray with respect to sheet discharge direction, wherein said stacking means is inclined so that the sheets stacked bridging between said first tray and said second tray slide by their own weight;

binding means for binding the sheets stacked on the first tray of said stacking means;

moving means for moving the sheets from said first tray toward said second tray; and selecting means for stacking the sheets on said second tray including said first tray in a mode in which the sheets are bound by said binding means, and for stacking the sheets directly on said second tray excluding said first tray of the stacking means in a mode in which the sheets are bound.

17. An apparatus according to claim 16, wherein further comprising an automatic document feeder for circulating originals to be copied, wherein plural originals are circulated a plural number of times to form plural sets of sheets which are bound by said binding means for each of the sets.

18. A sheet-processing apparatus, comprising:

means for discharging sheets;

stacking means for stacking the sheets discharged by said discharging means;

binding means for binding the sheets stacked on said stacking means;

moving means for moving the sheets bound by said binding means from said stacking means;

substantially vertically movable accommodating means, disposed downstream of said stacking means with respect to a sheet discharge direction and constituting a part of said stacking means, for accommodating the sheets moved from a first tray of said stacking means by said moving means; and selecting means for stacking the sheets on said accommodating means including said first tray of the stacking means in a mode in which the sheets are bound by said binding means, and for stacking the sheets directly on said accommodating means excluding said first tray of the stacking means in a mode in which the sheets are not bound.

19. A sheet-processing apparatus, comprising:

means for discharging sheets;

stacking means for stacking the sheets discharged by said discharging means, said stacking means including a first tray adjacent said discharging means for supporting trailing portions of the sheets discharged by said discharging means and a second tray for supporting leading portions of the sheets having the trailing portions supported by the first tray, said second tray movable substantially in the vertical direction and disposed downstream of said first tray with respect to a sheet discharge direction, wherein said stacking means is inclined so that the sheets stacked bridging between said first tray and said second tray slide by their own weight;

binding means for binding the sheets stacked on the first tray of said stacking means;

moving means for moving the sheets bound by said binding means toward said second tray; and means for shifting bound sets of sheets to prevent overlapping bound portions of adjacent sets.

20. An image forming apparatus, comprising:

means for forming images on sheets;

means for discharging the sheets on which images are formed by said image forming means;

stacking means for stacking the sheets discharged by said discharging means, said stacking means including a first tray adjacent said discharging means for supporting trailing portions of the sheets discharged by said discharging means and a second tray for supporting leading portions of the sheet having the trailing portions supported by the first tray, said second tray movable substantially in the vertical direction and disposed downstream of said first tray with respect to a sheet discharge direction, wherein said stacking means is inclined so that the sheets stacked bridging between said first tray and said second tray slide by their own weight;

binding means for binding the sheets stacked on the first tray of said stacking means; and moving means for moving the sheets bound by said binding means toward said second tray.

21. An image forming apparatus, comprising:

means for forming images on sheets;

means for discharging sheets on which images are formed by said image forming means;

stacking means for stacking the sheets discharged by said discharging means;

binding means for binding the sheets stacked on said stacking means;

moving means for moving the sheets bound by said binding means from said stacking means;

substantially vertically movable accommodating means, disposed downstream of said stacking means with respect to a sheet discharge direction and constituting a part of said stacking means, for accommodating the sheets moved from a first tray of said stacking means by said moving means; and selecting means for stacking the sheets on said accommodating means including said first tray of the stacking means in a mode in which the sheets are bound by said binding means, and for stacking the sheets directly on said accommodating means excluding said first tray of the stacking means in a mode which the sheets are not bound.

* * * * *

UNITED STATES PATENT AND TRADEMARK OFFICE

CERTIFICATE OF CORRECTION

PATENT NO. : 5,385,340

DATED : January 31, 1995

INVENTOR(S) : MASAKAZU HIROI, ET AL.

It is certified that error appears in the above-indentified patent and that said Letters Patent is hereby corrected as shown below:

Drawings:

Figure 29,
"SENOR" should read --SENSOR--, and "POLLER" should read "ROLLER".

Column 1,
line 13, "handing" should read --handling--; and
line 46, "has" should read --have--.

Column 2,
line 55, "the" should read --of--.

Column 3,
line 26, "preset" should read --present--; and
line 30, "illustrated detailed" should read --illustrates detail--.

Column 4,
line 30, "cassette 1.51" should read --cassette 151--.

Column 6,
line 37, "roller°" should read --roller.--;
line 47, "its" should be deleted;
line 48, "and" should be deleted; and
line 53, "roller 17" should read --roller 19--.

UNITED STATES PATENT AND TRADEMARK OFFICE

CERTIFICATE OF CORRECTION

PATENT NO. : 5,385,340

DATED : January 31, 1995

INVENTOR(S) : MASAKAZU HIROI, ET AL.

It is certified that error appears in the above-indentified patent and that said Letters Patent is hereby corrected as shown below:

Column 7,
line 63, ".reference" should read --reference--.
Column 8,
line 26, "has" should read --have--.
Column 9,
line 6, "operation" should read --operations--; and
line 66, "step 518" should read --step S18--.
Column 10,
line 18, "motor 403" should read --motor 203--;
line 23, "FIG. !0" should read --FIG. 10--; and
line 50, "tile" should read --the--.
Column 11,
line 10, "embodiment" should read --embodiment,--; and
line 50, "weighting" should read --waiting--.
Column 12,
line 45, "he" should read --the--; and
line 49, "sheets" should read --sheet--.
Column 13,
line 47, "form" should read --for--; and
line 58, "are" should read --and are--.

UNITED STATES PATENT AND TRADEMARK OFFICE

CERTIFICATE OF CORRECTION

PATENT NO. : 5,385,340

DATED : January 31, 1995

INVENTOR(S) : MASAKAZU HIROI, ET AL.

It is certified that error appears in the above-indentified patent and that said Letters Patent is hereby corrected as shown below:

Column 14,
line 3, "sheet aligned." should read --aligned sheets.--; and
line 6, "with" should read --when--.

Column 15,
line 19, "or" should read --for--.

Column 16,
line 5, "at" should read --as--; and
line 48, "portion" should read --portions--.

Column 18,
line 1, "takes" should read --take--;
line 6, "descried." should read --described.--; and
line 27, "is" should read --are--.

Column 19,
line 12, "tioned" should read --tion--.

Column 21,
line 24, "are" should read --is--; and
line 58, "not;" should read --not,--.

Column 22,
line 33, "two it" should read --two. It--; and
line 36, "are" should read --is--.

Column 23,
line 11, "into" should read --to--.

Signed and Sealed this

Ninth Day of May, 1995

Bruce Lehman

*Attest:*

BRUCE LEHMAN

*Attesting Officer*

*Commissioner of Patents and Trademarks*